US011959184B2

(12) United States Patent
Jiao et al.

(10) Patent No.: US 11,959,184 B2
(45) Date of Patent: Apr. 16, 2024

(54) ELECTROCHEMICAL GENERATION OF CARBON-CONTAINING PRODUCTS FROM CARBON DIOXIDE AND CARBON MONOXIDE

(71) Applicant: University of Delaware, Newark, DE (US)

(72) Inventors: Feng Jiao, Newark, DE (US); Matthew Jouny, Easton, PA (US); Jing-Jing Lv, Nanjing (CN)

(73) Assignee: University of Delaware, Newark, DE (US)

( * ) Notice: Subject to any disclaimer, the term of this patent is extended or adjusted under 35 U.S.C. 154(b) by 0 days.

(21) Appl. No.: 17/044,379

(22) PCT Filed: Apr. 11, 2019

(86) PCT No.: PCT/US2019/027012
§ 371 (c)(1),
(2) Date: Oct. 1, 2020

(87) PCT Pub. No.: WO2019/200115
PCT Pub. Date: Oct. 17, 2019

(65) Prior Publication Data

US 2021/0140056 A1 May 13, 2021

Related U.S. Application Data

(60) Provisional application No. 62/757,785, filed on Nov. 9, 2018, provisional application No. 62/655,899, filed on Apr. 11, 2018.

(51) Int. Cl.
*C25B 3/03* (2021.01)
*C25B 1/23* (2021.01)
(Continued)

(52) U.S. Cl.
CPC ..... *C25B 3/26* (2021.01); *C25B 1/23* (2021.01); *C25B 9/19* (2021.01)

(58) Field of Classification Search
CPC .... C25B 3/01; C25B 3/03; C25B 3/09; C25B 3/26; C25B 9/19; C25B 3/25; C26B 3/07
(Continued)

(56) References Cited

U.S. PATENT DOCUMENTS 3,032,489 A 5/1962 Loveland
4,072,583 A 2/1978 Hallcher et al.
(Continued)

OTHER PUBLICATIONS

Del Castillo et al., "Sn Nanoparticles on Gas Diffusion Electrodes: Synthesis, Characterization and Use for Continuous CO2 Electroreduction to Formate," Journal of CO2 Utilization (Mar. 1, 2017), vol. 18, pp. 222-228. (Year: 2017).*
(Continued)

*Primary Examiner* — Edna Wong
(74) *Attorney, Agent, or Firm* — Mendelsohn Dunleavy, P.C.

(57) ABSTRACT

Disclosed herein is a method of electroreduction with a working electrode and counter electrode. The method includes a step of electrocatalyzing carbon monoxide and/or carbon dioxide in the presence of one or more nucleophilic co-reactants in contact with a catalytically active material present on the working electrode, thereby forming one or more carbon-containing products electrocatalytically.

17 Claims, 13 Drawing Sheets

(51) Int. Cl.

| | |
|---|---|
| ***C25B 3/07*** | (2021.01) |
| ***C25B 3/09*** | (2021.01) |
| ***C25B 3/25*** | (2021.01) |
| ***C25B 3/26*** | (2021.01) |
| ***C25B 9/19*** | (2021.01) |

(58) Field of Classification Search
USPC ..... 205/436, 440, 445, 448, 450, 431
See application file for complete search history.

(56) References Cited

U.S. PATENT DOCUMENTS

| | | | | |
|---|---|---|---|---|
| 4,959,131 | A * | 9/1990 | Cook | C25B 9/23 205/462 |
| 2012/0132537 | A1* | 5/2012 | Sivasankar | C25B 3/23 205/450 |
| 2017/0244109 | A1* | 8/2017 | O'Malley | C25B 9/23 |
| 2018/0216243 | A1* | 8/2018 | Kudo | C25B 9/73 |
| 2018/0265440 | A1* | 9/2018 | Kudo | C25B 1/00 |
| 2019/0292668 | A1* | 9/2019 | Fujinuma | C25B 9/19 |
| 2020/0347502 | A1* | 11/2020 | Dismukes | B01J 23/72 |
| 2021/0079538 | A1* | 3/2021 | Schmid | C25B 9/19 |

OTHER PUBLICATIONS

Han et al., "High-Rate Electrochemical Reduction of Carbon Monoxide to Ethylene Using Cu-Nanoparticle-Based Gas Diffusion Electrodes," ACS Energy Letters (Mar. 13, 2018), vol. 3, No. 4, pp. 855-860. (Year: 2018).*
Herron et al., "A General Framework for the Assessment of Solar Fuel Technologies," Energy Environ. Sci., 2015, 8(1), pp. 126-157.
Birdja et al., "The Importance of Cannizzaro-Type Reactions during Electrocatalytic Reduction of Carbon Dioxide," J. Am. Chem. Soc., 2017, 139, pp. 2030-2034.
Cook et al, "High Rate Gas Phase CO2 Reduction to Ethylene and Methane Using Gas Diffusion Electrodes," Journal of the Electrochemical Society, vol. 137, Issue 2, Feb. 1, 1990, pp. 607-608.
Corrigan, D., "The Catalysis of the Oxygen Evolution Reaction by Iron Impurities in Thin Film Nickel Oxide Electrodes," Journal of the Electrochemical Society: Electrochemical Science and Technology, vol. 123, Issue 2, Feb. 1, 1987, pp. 377-384.
Dinh et al., "CO2 Electroreduction to Ethylene via Hydroxide-mediated Copper Catalysis at an Abrupt Interface," Science 360, 2018, pp. 783-787.
Feng et al., "A Direct Grain-Boundary-Activity Correlation for CO Electroreduction on Cu Nanoparticles," ACS Cent. Sci., 2016, 2, pp. 169-174.
Liu et al., "Understanding Trends in Electrochemical Carbon Dioxide Reduction Rates," Nat. Commun., 2017, 8:15438, 7 pages.
Ripatti et al., "Carbon Monoxide Gas Diffusion Electrolysis that Produces Concentrated C2 Products with High Single-Pass Conversion," Joule, Jan. 16, 2019;3(1):240-56.
Xiao et al., "Mechanistic Explanation of the pH Dependence and Onset Potentials for Hydrocarbon Products from Electrochemical Reduction of CO on Cu (111)," J. Am. Chem. Soc., 2016, 138, pp. 483-486.
Yuan et al, "Efficient Electrochemical Dicarboxylations of Arylacetylenes with Carbon Dioxide using Nickel as the Cathode," Tetrahedron, vol. 64, Apr. 18, 2008, pp. 5866-5872.
International Search Report and Written Opinion for International Application PCT/US2019/027012, dated Jul. 5, 2019, 8 pages.
Baturina et al., "CO2 Electroreduction to Hydrocarbons on Carbon-Supported Cu Nanoparticles," ACS Catal. 4, (2014), 3682-3695.
Calle—Vallejo et al., "Theoretical Considerations on the Electroreduction of CO to C2 Species on Cu(I00) Electrodes," Angew. Chem. Int. Ed., 2013, 125, 7423-7426.
Garza et al., "Mechanism of CO2 Reduction at Copper Surfaces: Pathways to C2 Products," ACS Catal., 2018, 8, 1490-1499.
Greenzaid et al., "A nuclear magnetic resonance study of the reversible hydration of aliphatic aldehydes and ketones. II. The acid-catalyzed oxygen exchange of acetaldehyde," J. Am. Chem. Soc., 1967, 89(4), 756-759.
Huang et al., "Electrochemical Reduction of CO2 Using Copper Single-Crystal Surfaces: Effects of CO* Coverage on the Selective Formation of Ethylene," ACS Catal., 2017, 7, 1749-1756.
Jhong et al., "Electrochemical conversion of CO2 to useful chemicals: current status, remaining challenges, and future opportunities," Curr. Opin. Chem. Eng., 2013, 2, 191-199.
Li et al., "Electroreduction of carbon monoxide to liquid fuel on oxide-derived nanocrystalline copper," Nature 508, 504-507, (2014).
Loiudice et al., "Tailoring copper nanocrystals towards C2 products in electrochemical CO2 reduction," Angew. Chem. Int. Ed., 2016, 55, 5789-5792.
Montoya et al., "Theoretical Insights into a CO Dimerization Mechanism in CO2 Electroreduction," J. Phys. Chem. Lett., 2015, 6, 2032-2037.
Reske et al., "Particle size effects in the catalytic electroreduction of CO2 on Cu nanoparticles," J. Am. Chem. Soc., 2014, 136, 6978-6986.
Spurgeon et al., "A comparative technoeconomic analysis of pathways for commercial electrochemical CO2 reduction to liquid products," Energy Environ. Sci., 2018, 11, 1536-1551.
Verma et al., "Insights into the Low Overpotential Electroreduction of CO2 to CO on a Supported Gold Catalyst in an Alkaline Flow Electrolyzer," ACS Energy Lett., 2018, 3, 193-198.
Verma et al., "The effect of electrolyte composition on the electroreduction of CO2 to CO on Ag based gas diffusion electrodes," Phys. Chem. Chem. Phys., 2016, 18, 7075-7084.
Jouny et al., "Formation of carbon-nitrogen bonds in carbon monoxide electrolysis," Nature Chemistry, vol. 11, Sep. 2019, 11(9), 846-851.
Jouny et al., "High-rate electroreduction of carbon monoxide to multi-carbon products," Nature Catalysis, 2018, 1(10), 748-755.
International Preliminary Report on Patentability for International Application PCT/US2019/027012, dated Oct. 13, 2020, 7 pages.
Bertheussen et al., "Acetaldehyde as an Intermediate in the Electroreduction of Carbon Monoxide to Ethanol on Oxide-Derived Copper," Angew. Chem. Int. Ed. 2016, 55, 1450-1454.
Cheng et al., "Free-Energy Barriers and Reaction Mechanisms for the Electrochemical Reduction of CO on the Cu (100) Surface, Including Multiple Layers of Explicit Solvent at pH 0," J. Phys. Chem. Lett. 2015, 6, 4767-4773.
Cheng et al., "Full atomistic reaction mechanism with kinetics for CO reduction on Cu(100) from ab initio molecular dynamics free-energy calculations at 298 K," PNAS, Feb. 21, 2017, vol. 114, No. 8, 1795-1800.
Hori et al., "Electrochemical CO2 Reduction on Metal Electrodes," Modern Aspects of Electrochemistry No. 42, edited by C. Vayenas et al., Springer, New York, 2008, 106 pages.
Hori et al., "Formation of Hydrocarbons in the Electrochemical Reduction of Carbon Dioxide at a Copper Electrode in Aqueous Solution," J. Chem. Soc., Faraday Trans. 1, 1989, 85(8), 2309-2326.
Kim et al., "Regulating the Product Distribution of CO Reduction by the Atomic-Level Structural Modification of the Cu Electrode Surface," Electrocatalysis (2016) 7:391-399.
Verdaguer-Casadevall et al., "Probing the Active Surface Sites for CO Reduction on Oxide-Derived Copper Electrocatalysts," Journal of the American Chemical Society, 137, 9808-9811 (2015).
Hori et al., "Electrochemical reduction of carbon monoxide to hydrocarbons at various metal electrodes in aqueous solution," Chemistry Letters, Aug. 5, 1987;16(8):1665-8.
Raciti, D. et al., "Low-overpotential electroreduction of carbon monoxide using copper nanowires," ACS Catal. 7, 4467-4472 (2017).

* cited by examiner

ELECTROCHEMICAL GENERATION OF CARBON-CONTAINING PRODUCTS FROM CARBON DIOXIDE AND CARBON MONOXIDE

CROSS-REFERENCE TO RELATED APPLICATION

This application is a national stage application under 35 U.S.C. § 371 of International Application No. PCT/US2019/027012, filed Apr. 11, 2019, which claims benefit to U.S. Provisional Patent Application Nos. 62/655,899, filed Apr. 11, 2018 and 62/757,785, filed Nov. 9, 2018, the entire disclosures of each of these applications are incorporated herein by reference for all purposes.

STATEMENT REGARDING FEDERALLY SPONSORED RESEARCH

This invention was made with government support under Grant No. DE-FE0029868 awarded by the Department of Energy and Grant No. CBET-1350911 awarded by the National Science Foundation. The government has certain rights in the invention.

BACKGROUND OF THE INVENTION

Electrochemical conversion of carbon dioxide ($CO_2$) using renewable electricity is an attractive means for sustainable production of fuels and chemicals. The electrolysis of carbon dioxide ($CO_2$) has attracted significant attention as a process to produce high-value chemicals such as ethylene and ethanol, but current state-of-the-art $CO_2$ electrolyzers generally suffer from low selectivity and high overpotentials at practical reaction rates (>300 mA/cm$^2$).

As an alternative to direct $CO_2$ electrolysis, a two-step cascade process where $CO_2$ is initially reduced to carbon monoxide (CO) and then sequentially reduced to multi-carbon ($C_{2+}$) products holds several advantages. As CO is widely accepted as a key reaction intermediate for C—C coupling in carbon dioxide reduction ($CO_2R$), directly feeding CO as the reactant into a CO electrolyzer to increase the near-surface CO concentration (and consequently *CO surface coverage) may significantly enhance the performance toward producing $C_{2+}$ products. Furthermore, CO reduction (COR) can be done in alkaline electrolytes that suppress the competitive hydrogen evolution reaction, improve charge transfer kinetics, and boost selectivity towards $C_{2+}$ products, without the significant carbonate formation that plagues $CO_2$ reduction.

Nonetheless, only four major $C_{2+}$ products, i.e., ethylene, acetate salt, ethanol, and n-propanol, have been reported for $CO_2$/CO electrolysis in aqueous electrolytes. Hence, there is a need to overcome existing challenges, such as increasing selectivity and decreasing overpotential and to expand approach beyond simple C—C coupling.

SUMMARY OF THE INVENTION

Disclosed herein are three-compartment and two-compartment CO flow electrolyzers in which a hydrophobic porous carbon support is loaded with a copper catalyst and positioned between a fluid chamber and an electrolyte chamber where CO is directly fed on one side while electrolyte is fed on the other (FIG. 1A). The well-engineered electrode-electrolyte interface (FIG. 1A, blown up) allows conversion of CO at high reaction rates with a remarkable $C_{2+}$ selectivity. At the optimal conditions, the flow cell utilizing an OD-Cu catalyst exhibits a 91% $C_{2+}$ selectivity at a partial current density of 635 mA/cm$^2$, representing the highest performance that has ever been achieved for COR. Further studies revealed that maintaining an efficient electrode-electrolyte interface where gaseous reactant/products can easily transport in/out of the porous electrode without disrupting ionic and electrical conductivity is crucial for a stable performance at high reaction rates. Additionally, a comparison of $CO_2R$ (carbon dioxide reduction) and COR performances in an identical setup demonstrated that CO reduction has multiple advantages over $CO_2$ reduction in a flow cell configuration, such as a higher $C_{2+}$ selectivity and a more robust interface. Finally, surface pH calculations under COR and $CO_2R$ conditions and isotopic labelling studies suggest that the higher surface pH for COR facilitates the improved activity as well as acetate production.

In an aspect, a method of electroreduction with a working electrode and counter electrode is provided. The method comprising electrocatalyzing carbon monoxide or carbon dioxide in the presence of one or more nucleophilic co-reactants in contact with a catalytically active material present on the working electrode, thereby forming one or more carbon-containing products electrocatalytically.

In an embodiment of the method, the counter electrode is an anode comprising an anodic catalytically active material comprised of at least one metal selected from the group consisting of iridium, nickel, iron, and tin. In another embodiment, the at least one metal is present, at least in part, as a metal oxide. In another embodiment, the working electrode is a cathode comprising a cathodic catalytically active material comprised of at least one of copper, copper oxide, or a copper containing material. The cathodic catalytically active material may be present on a carbon or a conductive support which is dispersed in an ion conducting polymer or a hydrophobic polymer and deposited on a porous gas diffusion layer or porous membrane material. In an embodiment, the one or more nucleophilic co-reactants are selected from the group consisting of ammonia, amines, water, alcohols, carboxylic acids and thiols. In another embodiment, the one or more nucleophilic co-reactants are selected from the group consisting of C1-C6 aliphatic primary amines, C1-C6 aliphatic secondary amines, aromatic primary amines, and aromatic secondary amines. In yet another embodiment, the one or more carbon-containing products comprise one or more carbon-containing products selected from the group consisting of ethylene, acetic acid, acetaldehyde, ethanol, propanol, amides, and thioesters.

In an aspect, the method further comprises using an anolyte and an optional catholyte, wherein the anolyte comprises at least one metal cation and wherein the catholyte comprises at least one of carbonate, bicarbonate, chloride, iodide, hydroxide or other anion.

In an embodiment, the method further comprises streaming the anolyte through an anolyte chamber, at least one of carbon monoxide or carbon dioxide through a fluid chamber and optionally a catholyte through an optional catholyte chamber of an electrolyzer and streaming one or more nucleophilic co-reactants with the anolyte, at least one of carbon monoxide or carbon dioxide or the optional catholyte. The method also comprises electrically connecting the anode and the cathode using a source of electrical current and electrocatalyzing at least one of carbon monoxide or carbon dioxide in the presence of the one or more nucleophilic co-reactants in contact with a catalytically active material present on the working electrode, thereby forming one or more carbon-containing chemical products electrocatalytically.

In an embodiment, the porous membrane comprises an anion exchange membrane.

BRIEF DESCRIPTION OF THE DRAWINGS

The accompanying drawings, which are incorporated in and constitute a part of this specification, illustrate several embodiments of the invention, and together with the written description, serve to explain certain principles of the invention.

DETAILED DESCRIPTION OF THE INVENTION

Figure 1A:
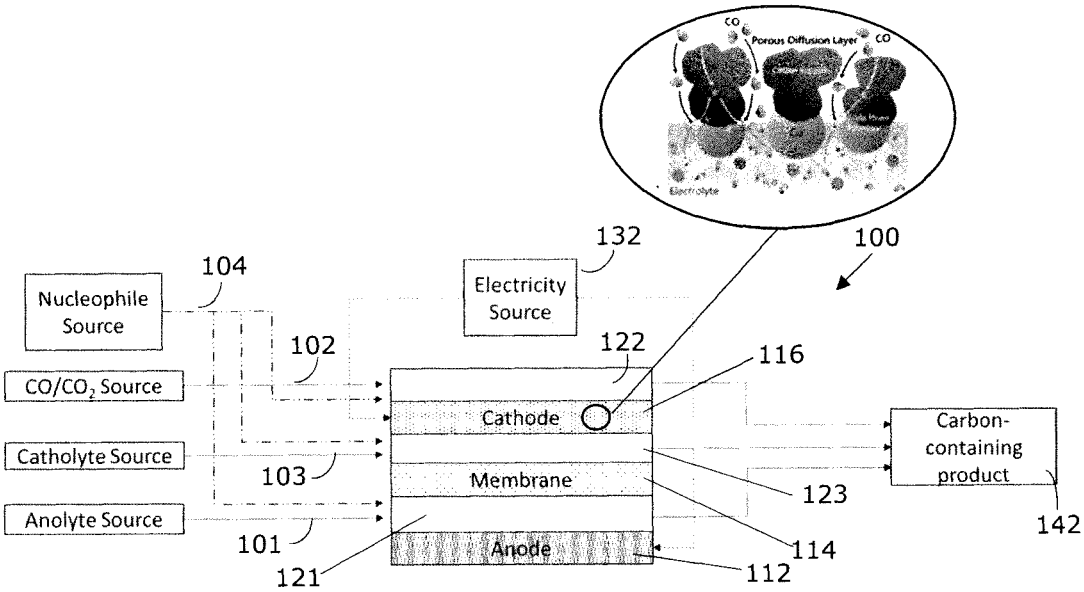
FIG. 1A shows a schematic illustration of a three-compartment CO flow electrolyzer.

Disclosed herein is a method of electroreduction with a working electrode and a counter electrode comprising: electrocatalyzing carbon monoxide or carbon dioxide in the presence of one or more nucleophilic co-reactants in contact with a catalytically active material present on the working electrode, thereby forming one or more carbon-containing products electrocatalytically.

In an embodiment, the counter electrode is an anode including an anodic catalytically active material. The anode is comprised of at least one metal selected from the group consisting of iridium, nickel, iron, and tin. Additionally, the at least one metal may be present, at least in part, as a metal oxide. Suitable examples of anode may include, but are not limited to Ir/$IrO_2$, NiO, $Co_3O_4$, Fe—$NiO_x$, $RuO_2$, $MnO_2$, $Mn_2O_3$, and Co—$PO_x$.

In another embodiment, the anode is "metal-free." As used herein, the term "metal-free" refers to an anodic catalytically active material which does not contain an active metal component. Suitable examples of "metal-free" anodes include, but are not limited to, conductive carbon, graphitic carbon, graphene, and functionalized graphene-based materials.

In one embodiment, the anode comprises a layer of anodic catalytically active material on at least one side of a support. In yet another embodiment, the layer of anodic catalytically active material is formed of particles, such as nanoparticles, microparticles or a mixture thereof to tune the porosity of the anode. The particle size can be in the range of 1 nm to 10 μm. In a further embodiment, the particles of the layer of anodic catalytically active material may be dispersed in an ion conducting polymer or a hydrophobic polymer. The anodic catalytically active material may be present in any suitable amount in the anode, such as in an amount of 0.01-100 $mg/cm^2$, 0.01-1 $mg/cm^2$ or 1-10 $mg/cm^2$ or 10-100 $mg/cm^2$.

Any suitable gas diffusion layer material may be used, including but not limited to carbon paper, carbon fibers, carbon cloth, porous graphene, metal mesh and metal foam with or without surface coatings.

Suitable examples of ion conducting polymers include, but are not limited to, anion conducting polymers, cation conducting polymers, and bipolar polymers.

Suitable examples of hydrophobic polymers include, but are not limited to, ion conducting ionomers, Teflon®, and PTFE.

In an embodiment, the working electrode is a cathode comprising a cathodic catalytically active material comprised of at least one of copper, copper oxide, or a copper containing material. In one embodiment, the cathode comprises a layer of cathodic catalytically active material on at least one side of a support. In yet another embodiment, the layer of anodic catalytically active material is formed of particles, such as nanoparticles, microparticles or a mixture thereof to tune the porosity of the cathode. The particle size can be in the range of 1 nm-20 μm or 1 nm-0.5 μm or 0.5-1.5 μm or 2-20 μm. In a further embodiment, the particles of the layer of cathodic catalytically active material may be dispersed in an ion conducting polymer or a hydrophobic polymer. The cathodic catalytically active material may be present in any suitable amount in the cathode, such as in an amount of 0.01-100 $mg/cm^2$ or 0.01-1 $mg/cm^2$ or 1-10 $mg/cm^2$ or 10-100 $mg/cm^2$.

In an embodiment, the cathodic catalytically active material is an "oxide-derived copper" (hereinafter referred to as "OD-Cu"). OD-Cu can be prepared by annealing micron size copper particles at a temperature in the range of 100-1100° C., for any suitable amount of time, such as at 500° C. for 2 hours. During annealing, copper particles undergo a change in morphology from spherical particles to irregular shaped, size, and also phase transition from cubic metallic Cu to monoclinic CuO. The resulting CuO particles can then be dispersed in a catalyst ink with multi-walled carbon nanotubes present in an amount of 0.01-10 mg per mg of Cu, and then a layer of cathodic catalytically active material can be formed onto a gas-diffusion layer (GDL) using any suitable method such as drop-cast, spraying, or wet-impregnation. The cathode can then be pre-conditioned through an in-situ electrochemical reduction at a constant current density of 1-200 $mA/cm^2$. After the pre-conditioning, the OD-Cu sample became highly porous with a pore size of 10-20 nm.

Any suitable catalyst ink can be used, including, but not limited to, a mixture of solvents, catalyst particles, and binders.

In another embodiment, the cathodic catalytically active material is present on a carbon support or a conductive support which is dispersed in an ion conducting polymer or a hydrophobic polymer and deposited on a porous gas diffusion layer or porous membrane material.

Referring back to the method of electroreduction, any suitable nucleophilic co-reactant may be used. The one or more nucleophilic co-reactants may be selected from the group consisting of ammonia, amines, water, alcohols, carboxylic acids and thiols. The nucleophilic co-reactant may comprise one or more nucleophilic functional groups per molecule bearing at least one active hydrogen, wherein the functional group(s) may be selected from hydroxyl (—OH), thiol (—SH), carboxyl (—$CO_2H$), or primary or secondary amino (—NHR, wherein R is H or an organic group). The nucleophilic co-reactant may comprise no carbon atoms (as in the case of water and ammonia) or one or more carbon atoms. In one embodiment, the one or more nucleophilic co-reactants are selected from the group consisting of C1-C6 aliphatic primary amines, C1-C6 aliphatic secondary amines, aromatic primary amines, and aromatic secondary amines. Exemplary nucleophilic co-reactants include, but are not limited to, ammonia, methylamine, ethylamine, dimethylamine, water, glycine, ethanol amine, and hydroxide.

The one or more nucleophilic co-reactants may be used in any suitable amount. In one embodiment, the ratio of at least one of carbon monoxide or carbon dioxide and the one or more nucleophilic co-reactants is in the range of 0.01-100 or 100-0.01 (mol/mol) ratio. In an embodiment, the ratio of $NH_3$ to CO is 2:1 (mol/mol) ratio.

According to embodiments of the present invention, the one or more carbon-containing products may comprise one or more carbon-containing products selected from the group consisting of ethylene, carboxylic acids (e.g., acetic acid), aldehydes (e.g., acetaldehyde), alcohols (e.g., ethanol, propanol), amides, and thioesters. In certain embodiments, the carbon-containing products may be multi-functional (i.e., they may contain two or more different types of functional groups, such as both an amide functional group and a hydroxyl functional group or both an amide functional group and a carboxylic acid functional group). Generally speaking, the one or more carbon-containing products include one or more products which contain an additional carbon as compared to the number of carbons in the nucleophilic co-reactant(s), wherein the additional carbon is derived from the carbon monoxide or carbon dioxide reacted with the nucleophilic co-reactant(s).

The electroreduction further utilizes an electrolyte. In certain embodiments, both an anolyte and a catholyte are employed. In other embodiments, only anolyte is employed. The anolyte and the catholyte may be the same as, or different from, each other. Any substance which provides ionic conductivity when dissolved in a suitable medium may be employed. The electrolyte, anolyte and/or catholyte are preferably dissolved in a liquid medium, such as water or a non-aqueous liquid solvent. Any of the electrolytes known in the art may be utilized, including for example metal salts comprising at least one metal cation (such as an alkali metal cation, e.g., sodium, potassium) and at least one anion selected from the group consisting of carbonate, bicarbonate, halides (e.g., chloride, iodide), and hydroxide. The choice of electrolyte has a significant impact on the selectivity of catalyst in electrochemical carbon monoxide and carbon dioxide reduction.

Figure 2:
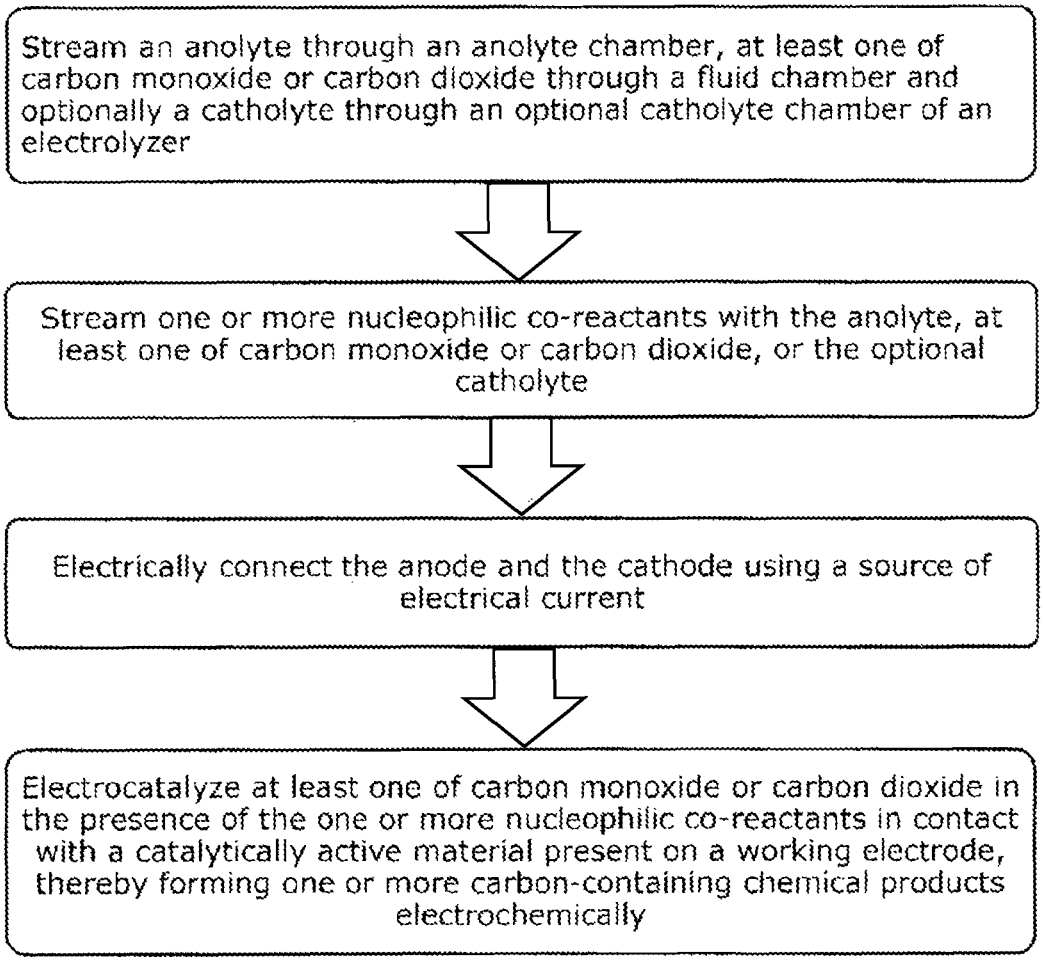
FIG. 2 is a flow chart of the method of electroreduction in accordance with various embodiments of the present invention.

The method of electroreduction as shown in FIG. 2 further comprises streaming an anolyte through an anolyte chamber, at least one of carbon monoxide or carbon dioxide through a fluid chamber and optionally a catholyte through an optional catholyte chamber of an electrolyzer. The method also includes streaming one or more nucleophilic co-reactants with the anolyte, at least one of carbon monoxide or carbon dioxide, or the optional catholyte. The method further includes electrically connecting the anode and the cathode using a source of electrical current and electrolyzing carbon monoxide or carbon dioxide in the presence of the one or more nucleophilic co-reactants in contact with a catalytically active material present on a working electrode, thereby forming one or more carbon-containing chemical products electrocatalytically.

In an aspect of the invention, the method of electroreduction comprises using a three-compartment electrolyzer 100 as shown in FIG. 1A. The electrolyzer 100 comprises an anolyte chamber 121 disposed in between an anode 112 and a porous membrane 114, a fluid chamber 122 disposed on a side of the cathode 116 opposite the porous membrane 114, a catholyte chamber 123 disposed in between a cathode 116 and the porous membrane 114, and a source of electrical current 132 for electrically connecting the anode 112 and the cathode 116.

Any suitable material may be used for the porous membrane, including but not limited to, anion exchange membrane, cation exchange membrane and bipolar membrane. Suitable examples of anion exchange membranes include FAA membranes, quaternary amine alkaline anion exchange membranes, and Sustainion® imidazolium-functionalized polymer membranes.

The method of electroreduction using the three-compartment electrolyzer 100 comprises streaming the anolyte 101 through the anolyte chamber 121 and streaming at least one of carbon monoxide or carbon dioxide 103 through the fluid chamber 122. The method also comprises streaming the catholyte 102 through the catholyte chamber 123 and streaming the one or more nucleophilic co-reactants 104 through at least one of the anolyte chamber 121, the fluid chamber 122, or the catholyte chamber 123. The method further comprises electrically connecting the anode 112 and the cathode 116 using a source 132 of electrical current and electrocatalyzing the at least one of carbon monoxide or carbon dioxide in the presence of the one or more nucleophilic co-reactants in contact with the cathodic catalytically active material present in the cathode 116, thereby forming carbon-containing products 142 electrocatalytically.

Figure 1B:
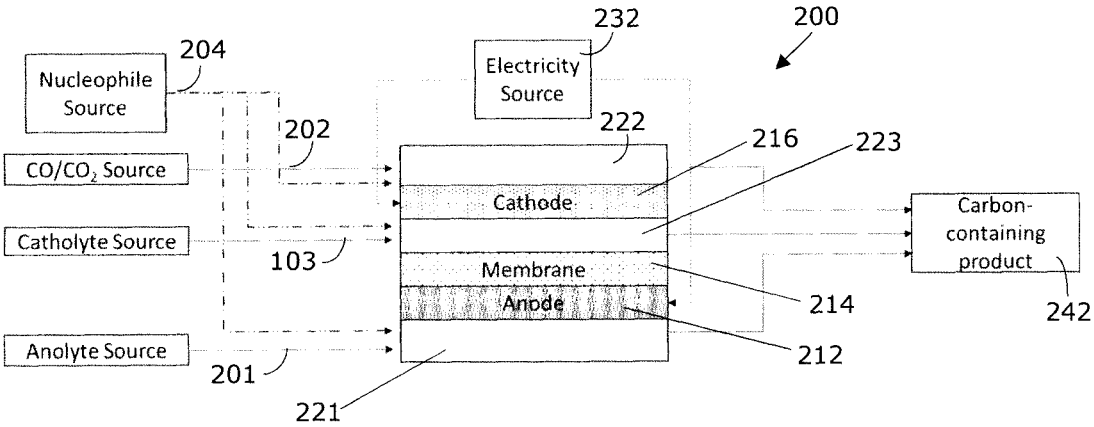
FIG. 1B shows a schematic illustration of a two-compartment CO flow electrolyzer.

In another aspect of the invention, the method of electroreduction comprises using a three-compartment electrolyzer 200 as shown in FIG. 1B. The electrolyzer 200 comprises an anode 212 disposed in contact with a porous membrane 214, an anolyte chamber 221 disposed on a side of the anode 212 opposite the porous membrane 214, a catholyte chamber 223 disposed in between the porous membrane 214 and a cathode 216, and a fluid chamber 122 disposed on a side of the cathode 216 opposite the porous membrane 214; and a source of electrical current 232 for electrically connecting the anode 212 and the cathode 216.

The method of electroreduction using an electrolyzer 200, as shown in FIG. 1B, comprises streaming the anolyte 201 through the anolyte chamber 221, streaming at least one of carbon monoxide or carbon dioxide 202 through the fluid chamber 222 and streaming the one or more nucleophilic co-reactants 204 through at least one of the anolyte chamber 221, the fluid chamber 222, or the catholyte chamber 223. The method also comprises electrically connecting the anode 212 and the porous cathode 216 using a source 232 of electrical current and electrocatalyzing the at least one of carbon monoxide or carbon dioxide in the presence of the one or more nucleophilic co-reactants in contact with the cathodic catalytically active material present in the cathode 216, thereby forming carbon-containing products 242 electrocatalytically.

Figure 1C:
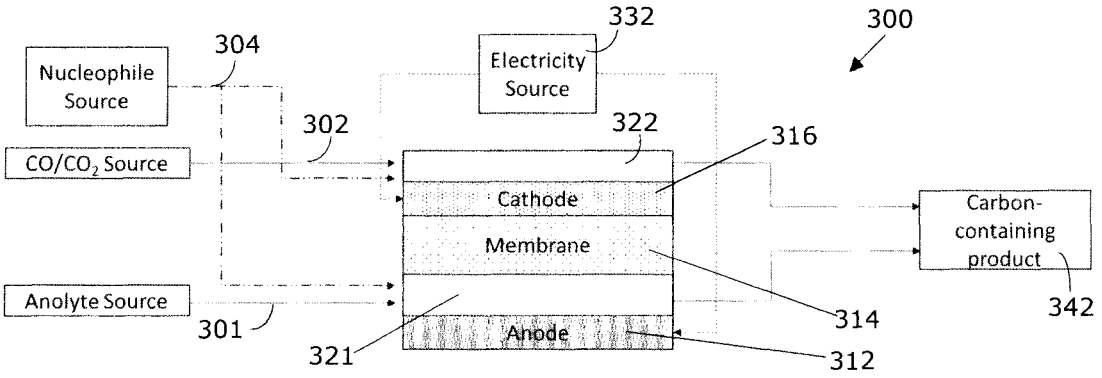
FIG. 1C shows a schematic illustration of another two-compartment CO flow electrolyzer.

In yet another aspect of the invention, the method of electroreduction comprises using a two-compartment electrolyzer 300 as shown in FIG. 1C. The two-compartment electrolyzer 300 comprises an anolyte chamber 321 disposed in between an anode 312 and a porous membrane 314 and a cathode 316 disposed in contact with the porous membrane 314 on a side opposite the anolyte chamber 321. The electrolyzer 300 also comprises a fluid chamber 322 disposed on a side of the cathode 316 opposite the porous membrane 314 and a source of electrical current 332 for electrically connecting the anode 312 and the porous cathode 314.

The method of electroreduction using the two-compartment electrolyzer 300, as shown in FIG. 1C, comprises streaming the anolyte 301 through the anolyte chamber 321, streaming at least one of carbon monoxide or carbon dioxide 302 through the fluid chamber 322, and streaming the one or more nucleophilic co-reactants through the anolyte chamber 321 or the fluid chamber 322. The method further comprises electrically connecting the anode 312 and the cathode 316 using a source 332 of electrical current and electrocatalyzing the at least one of carbon monoxide or carbon dioxide in the presence of the one or more nucleophilic co-reactants in contact with the cathodic catalytically active material present in the cathode 316, thereby forming carbon-containing products 342 electrocatalytically. In an embodiment, the nucleophilic co-reactant is water and the carbon-containing product 342 comprises an acetate salt.

Figure 1D:
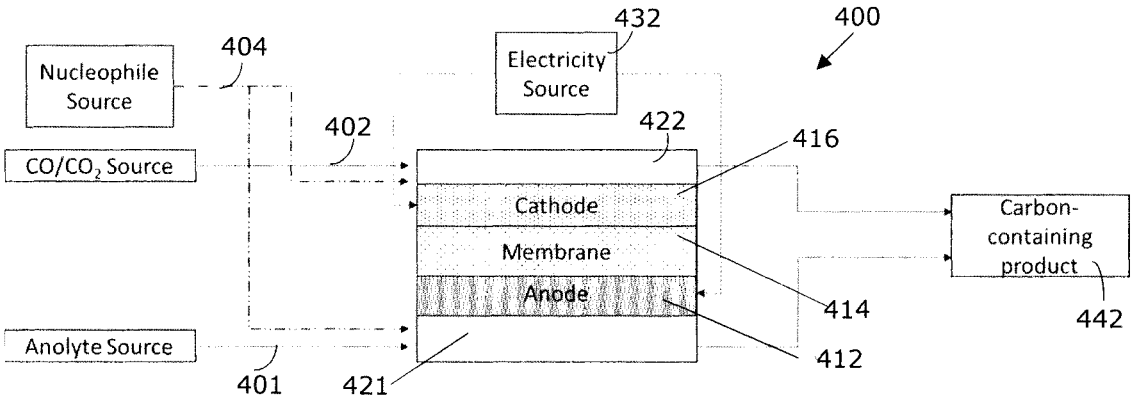
FIG. 1D shows a schematic illustration of another two-compartment CO flow electrolyzer.

In yet another aspect of the invention, the method of electroreduction comprises using a two-compartment electrolyzer 400 as shown in FIG. 1D. The two-compartment electrolyzer 400 comprises a porous membrane 314 sandwiched in between and in contact with an anode 412 on one side and a cathode 416 on the other side. The electrolyzer 400 also comprises an anolyte chamber 421 disposed on a side of the anode 412 opposite the porous membrane 414. The electrolyzer 400 also comprises a fluid chamber 422 disposed on a side of the cathode 416 opposite the porous membrane 414 and a source of electrical current 432 for electrically connecting the anode 412 and the cathode 414.

The method of electroreduction using the two-compartment electrolyzer 400, as shown in FIG. 1D, comprises streaming the anolyte 401 through the anolyte chamber 421, streaming at least one of carbon monoxide or carbon dioxide 402 through the fluid chamber 422, and streaming the one or more nucleophilic co-reactants through the anolyte chamber 421 or the fluid chamber 422. The method further comprises electrically connecting the porous anode 412 and the porous cathode 416 using a source 432 of electrical current and electrocatalyzing the at least one of carbon monoxide or carbon dioxide in the presence of the one or more nucleophilic co-reactants in contact with the cathodic catalytically active material present in the cathode 416, thereby forming carbon-containing products 442 electrocatalytically.

In an embodiment, method of electroreduction comprises using the two-compartment electrolyzer 400, as shown in FIG. 1D with water as the nucleophilic co-reactant, thereby resulting in the production of acetic acid as the carbon-containing product 442. In contrast, if another electrolyzer such as those shown in FIGS. 1A-1C is used with water as the nucleophilic co-reactant, then acetic acid may be produced under suitable pH conditions.

In an embodiment, exemplary nucleophilic co-reactants used in any of the electrolyzers shown in FIGS. 1A-1D include, but are not limited to, ammonia, methylamine, ethylamine, dimethylamine, glycine, ethanol amine, and hydroxide and the resulting carbon-containing products include, but are not limited to, amide, acetamide, N-methylacetamide, N-ethylacetamide, N,N-dimethylacetamide, aceturic acid or the corresponding salt, acetic monoethanolamide, and acetic acid or the corresponding salt.

In an embodiment, all of the in-streaming components—the anolyte, catholyte, at least one of carbon monoxide or carbon dioxide and one or more nucleophilic co-reactants—have the same directional flow and the out-streaming carbon-containing products have the same directional flow.

In another embodiment, at least one of the in-streaming components—the anolyte, catholyte, at least one of carbon monoxide or carbon dioxide and one or more nucleophilic co-reactants—have a directional flow opposite to the rest of the in-streaming components and at least one of the out-streaming components such as carbon-containing products have a directional flow opposite to the other out-streaming components.

In yet another embodiment, at least one of the in-streaming components—the anolyte, catholyte, at least one of carbon monoxide or carbon dioxide and one or more nucleophilic co-reactants—have a directional flow at an angle to the rest of the in-streaming components and at least one of the out-streaming components such as carbon-containing products have a directional flow opposite to the other out-streaming components.

In some embodiments, the in-streaming of the components—the anolyte, catholyte, at least one of carbon monoxide or carbon dioxide and one or more nucleophilic co-reactants—is done in a steady continuous flow. In an embodiment, the flow rate of the anolyte, catholyte, at least one of carbon monoxide or carbon dioxide and one or more nucleophilic co-reactants is in the range of 0.01-100 mL/min per $cm^2$ of electrode.

The electrocatalytical production of carbon-containing products in accordance with the present disclosure has a Faradaic efficiency of at least 1% at a current density in the range of 0.1-3000 $mA/cm^2$ or 0.1-100 $mA/cm^2$ or 100-1000 $mA/cm^2$ or 1000-3000 $mA/cm^2$.

The electrocatalytical production of carbon-containing products in accordance with the present disclosure has a $C_{2+}$ selectivity of at least 1% or at least 10% or at least 90%, wherein the $C_{2+}$ selectivity is calculated as:

The total number of electrons transferred to C2+ product (s) divided by the total number of electrons passed through the electrode.

In summary, disclosed herein is a CO flow electrolyzer that can achieve over 630 $mA/cm^2$ with a $C_{2+}$ selectivity above 90%, exceeding the performance for the current state-of-the-art COR and $CO_2R$ systems. The flow electrolyzer design successfully overcomes mass transport limitations associated with the low solubility of CO in aqueous electrolytes and allows the achievement of superior performances at high rates. This work also illustrated the critical need to design a robust electrode-electrolyte interface, which allowed the investigation of COR and $CO_2R$ at practical reaction rates. The comparison between COR and $CO_2R$ clearly demonstrates the potential advantages of CO electrolysis over $CO_2$ electrolysis to produce valuable $C_{2+}$ chemicals. With a $CO_2$-derived CO source or other CO-rich sources, CO electrolysis technology may be considered as an alternative approach to produce high-value $C_{2+}$ chemicals in practical applications.

Although the invention is illustrated and described herein with reference to specific embodiments, the invention is not intended to be limited to the details shown. Rather, various modifications may be made in the details within the scope and range of equivalents of the claims and without departing from the invention.

EXAMPLES

Examples of the present invention will now be described. The technical scope of the present invention is not limited to the examples described below.

Methods

Preparation of Electrodes

Commercial copper powder (0.5-1.5 μm, 99%) was purchased from Alfa Aesar and stored under Ar atmosphere. 1 g of copper powder was placed in a ceramic crucible and immediately heated to 500° C. for 2 hours. Following thermal annealing, the copper powder sintered into a black sheet, which was hand ground to form a fine powder. 100 mg of the powder was mixed with 0.5 mL tetrahydrofuran containing 0.5 mg/mL multiwalled carbon nanotubes (>98% carbon basis, O.D.×L 6-13 nm×2.5-20 μm, Sigma Aldrich), 2 mL of isopropanol, and 20 μL of Nafion© ionomer solution (10 wt % in $H_2O$). The oxide-derived copper (OD-Cu) electrode was prepared via in-situ electrochemical reduction at a constant current density of 15 $mA/cm^2$. An identical ink was prepared using the as-purchased commercial micron copper. The catalyst inks were sonicated for 30 minutes and then dropcast onto a Sigracet® 29 BC gas diffusion layer (GDL, Fuel Cell Store) to a loading of 1 $mg/cm^2$. $IrO_2$ anodes were prepared by mixing 50 mg $IrO_2$ nanoparticles (99%, Alfa Aesar) with 0.5 mL of DI $H_2O$, 2 mL of isopropanol, and 20 μL of Nafion© ionomer solution (10 wt % in $H_2O$), which was sonicated and dropcast onto Sigracet® 29BC GDL at 1 $mg/cm^2$ loading. A fresh cathode was used for each flow cell experiment, while anodes were reused 3 times.

Materials Characterization

All chemicals were of analytical grade and used as received without further purification unless otherwise noted. Commercial copper nanoparticles with 25 nm diameter ("Cu NPs") and bulk copper nanoparticles with 1 μm diameter ("micron Cu") were used as catalysts in this work, which were purchased from Sigma-Aldrich. The microstructure of the catalysts was characterized by field emission scanning electron microscopy (SEM, Auriga, 1.5 kV). Powder X-ray diffraction (XRD) measurements were conducted on a D8 ADVANCE X-ray diffractometer (Bruker Corporation, America) using a Cu Kα radiation source. A Thermo Scientific K-Alpha X-ray Photoelectron Spectrometer (XPS) System was used to analyse the surface composition near the surface. XPS fitting was conducted with CasaXPS software with the adventitious carbon peak being calibrated to 284.5 eV. All peaks were fitted using a Gaussian/Lorentzian product line shape and a Shirley background.

The electrochemical surface area (ECSA) was determined by measuring the double-layer capacitances of the commercial micron Cu and OD-Cu and comparing to a polycrystalline copper foil (99.999%, Alfa Aesar). The double layer capacitance (CDL) was found by performing cyclic voltammetry of the electrodes in 0.1M $HClO_4$ in a H-cell. The electrodes were scanned at scan rates of 10-100 mV/s in the potential region of no Faradaic current, and the observed current was plotted vs. scan rate to obtain the double layer capacitance. The ECSA was then calculated using the CDL for the copper foil.

In-situ X-ray adsorption spectroscopy (XAS) was performed at Beamline 5 BM-D at the Advanced Photon Source (APS) at Argonne National Laboratory through the general user program. The XAS data was processed using the IFEFFIT package, including Athena and Artemis. A modified two-compartment H-type electrochemical cell made from acrylic was used for in-situ XAS experiments. The electrolysis was performed in 0.1M potassium hydroxide under a flowing atmosphere of 5 sccm carbon monoxide. The OD-Cu electrodes were reduced at 10 mA/cm$^2$, and then held at potentials ranging from −0.2V to −0.5V vs. RHE.

Flow Cell Electrolysis

The electrolysis of CO and $CO_2$ were performed in a three-channel flow cell, schematically shown in FIG. 1A, with channels of dimension 2×0.5×0.15 cm$^3$. The electrode area was 1 cm$^2$ and the electrode to membrane distance was 1.5 mm. The flow cell design was modified based on engineering drawings kindly provided by Dr. Paul Kenis at University of Illinois at Urbana-Champaign (USA). The three-channel flow cell was fabricated from acrylic and included the fluid channel for feeding CO or $CO_2$ and co-reactant such as $NH_3$, anode and cathode channels for flowing electrolyte, an anion exchange membrane (FAA-3, Fumatech) for separating the anode and cathode, and solid acrylic end pieces. PTFE gaskets were placed between each component for sealing and the device was tightened using six bolts.

The electrolytes were aqueous solutions of potassium hydroxide (99.99%, Sigma Aldrich).

The gas flow rate was set at 10 sccm via a mass flow controller (Brooks GF40) and the co-reactant, such as $NH_3$, flow rate was controlled by a rotameter (Cole Parmer, PMR1-010286). The backpressure of the gas in the flow cell was controlled to atmospheric pressure using a backpressure controller (Cole-Parmer).

Electrolysis of CO and $CO_2$ Without a Co-Reactant

The catholyte and anolyte flow rates were controlled via a peristaltic pump, with the catholyte flow rate ranging from 0.1-1 mL/min depending on the current density (lower flow rates were used at lower current densities to allow for sufficient accumulation of liquid products). The anolyte flow rate was 5 mL/min.

Electrolysis of CO and $CO_2$ with a Co-Reactant, Such as Ammonia

The electrolyte flow rates were controlled via a peristaltic pump (Cole Parmer), with the catholyte and anolyte flow rates set to 0.5 mL/min and 1 mL/min, respectively.

Amines were scrubbed from the effluent gas from the flow cell using an acid trap (3 M $H_2SO_4$ solution) prior to entering the gas chromatograph (GC).

For CO electrolysis in the presence of ammonia, the fluid channel was co-fed with CO and $NH_3$, with 1M KOH used as the catholyte and anolyte (Ag/AgCl reference electrode). For CO electrolysis in the presence of liquid phase amines, a pure CO gas feed was used, with the catholyte consisting of the reactants ($NH_3$, $H_2O$, $CH_3NH_2$, $CH_3CH_2NH_2$, and $CH_3NHCH_3$) and a supporting electrolyte (KOH or KCl), and a 1 M KOH anolyte (Hg/HgO reference electrode). A NiFe/Ni foam anode, prepared following a previously reported method, was used as the anode electrode for the acetamide production stability test.

Chronopotentiometry

The chronopotentiometry experiments were performed using an Autolab PG128N. For the 3-electrode set-up experiments, the cathodic half-cell potential was measured using an external Ag/AgCl or Hg/HgO reference electrode located ~5 cm from the cathode. All potential measurements were converted to the RHE based on the following formula: $E_{RHE}=E_{Ag/AgCl}+E^{0}_{Ag/AgCl}+0.059\times pH$ (in volts) or $E_{RHE}=E_{Hg/HgO}+E^{0}_{Hg/HgO}+0.059\times pH$ (in volts). The measured pH values of bulk electrolyte were used for RHE conversions unless stated otherwise.

The resistance between the cathode and reference electrode was measured using the current-interrupt technique prior to each applied current density, and the measured applied potential was IR corrected following electrolysis. For each data point, the cell was allowed to reach steady state, and products were quantified over a 300 s period. At least three replicates were performed at each current density. For the CO/$CO_2$ gas switching experiments where the cell voltage is recorded over time, the voltage data were smoothed using the Savitzsky-Golay method to reduce oscillations due to bubble formation at the anode.

Product Quantification

Gas products were quantified using a Multigas #5 GC (SRI Instruments) equipped with a Hayesep® D and Molsieve 5A columns connected to a thermal conductivity detector (TCD) and a Hayesep® D column connected to a flame ionization detector (FID). Hydrogen was quantified using TCD, while ethylene, carbon monoxide (for $CO_2$ electrolysis), and methane were detected on both FID and TCD. The Faradaic efficiency for products was calculated using the following formula:

$$FE\ (\%) = \frac{nFxV}{j_{Tot}} \cdot 100 \tag{1}$$

where n=# of electrons transferred
F=Faraday's constant
x=mole fraction of product
V=total molar flow rate of gas
$j_{Tot}$=total current Liquid products were quantified using $^1$H NMR, in particular a Bruker AVIII 600 MHz NMR spectrometer. The $^1$H NMR spectra were obtained using a pre-saturation method for water suppression. Typically, 500 μL of collected catholyte exiting the reactor was mixed with 100 μL $D_2O$ containing 20 or 25 ppm (m/m) dimethyl sulfoxide (≥99.9%, Alfa Aesar) as the internal standard or 250 ppm (m/m) phenol (≥99%, Sigma-Aldrich) in $D_2O$. The one-dimensional $^1$H spectrum was measured with water suppression using a pre-saturation method.

Amide production was further verified by GC-MS (Agilent 59771A). The GC-MS spectral features were determined by comparing the mass fragmentation patterns with those of the National Institute of Standards and Technology library and focused on the shifts of the parent ion of the molecules.

Labelled $C^{18}O$ Electrolysis

The labelled isotope experiment was performed by using labelled $C^{18}O$ gas (a low pressure $C^{18}O$ lecture bottle with 95 at % $^{18}O$, Sigma-Aldrich) for electrolysis. Typically, the $C^{18}O$ was extracted by a 30 ml syringe and was injected to the flow cell at 5 mL min$^{-1}$ by a syringe pump, optionally along with a co-reactant such as $NH_3$ at a flow rate of 10 mL min$^{-1}$. Electrolysis was conducted at a constant current of 200 mA cm$^{-2}$ or 300 mA/cm$^2$ for 5 min and the catholyte was collected for analysis by GC-MS.

The liquid products, obtained without the use of a co-reactant, were acidified in an ice bath with hydrochloric acid to a pH value of ~2. Acidification did not affect the mass spectrum analysis, other than allowing for the detection of acetate through acetic acid. Identification of the liquid products was performed using an integrated gas chromatography-mass spectrometry (GC-MS, Agilent 59771A) system. The GC (Agilent 7890B) was equipped with a DB-FFAP column and interfaced directly to the MS (Agilent 59771A). Identification of the GC-MS spectral features were accomplished by comparing the mass fragmentation patterns with those of the NIST library and focused on the shifts of the parent ion of the molecules.

Catalyst Characterization and COR Performance

OD-Cu catalyst was prepared following a literature procedure (Li, C. W., Ciston, J. & Kanan, M. W. Electroreduction of carbon monoxide to liquid fuel on oxide-derived nanocrystalline copper. *Nature* 508, 504-507, (2014)), where Cu particles were annealed in air, followed by an in-situ electrochemical reduction treatment. In a typical preparation, commercial Cu particles ("micron Cu") with an average particle size of 0.5-1.5 μm were first annealed at 500° C. for 2 hours. After annealing, a clear morphology change from spherical particles to irregular particles (0.1 to 1 μm) was observed and a typical scanning electron microscopy (SEM) image is shown in. Structural characterizations using powder X-ray diffraction (XRD) technique revealed a phase transition from cubic metallic Cu into monoclinic CuO, which is consistent with X-ray photoelectron spectroscopy (XPS) results. The resulting CuO particles were dispersed in a catalyst ink with a small amount of multi-walled carbon nanotubes and dropcast onto a gas-diffusion layer (GDL) with a final catalyst loading of ~1 mg/cm$^2$. The electrode was then pre-conditioned through an in-situ electrochemical reduction at a constant current density of 15 mA/cm$^2$. After the pre-conditioning, the OD-Cu sample became highly porous with a pore size of 10-20 nm. In-situ X-ray absorption spectroscopy (XAS) under COR conditions (5 mA/cm$^2$ in 0.1M KOH) in a custom-built H-cell indicates that the catalyst is metallic $Cu^0$ after pre-reduction and under reaction conditions. The micron Cu electrodes were prepared using the same commercial Cu powder and the spherical morphology of the particles was maintained throughout the preparation procedure.

The COR activities of both OD-Cu and micron Cu electrodes were evaluated using a three-compartment flow electrolyzer (FIG. 1A). The COR results are summarized in FIG. 3 and the products detected in significant quantities were ethanol, acetate, ethylene, and n-propanol, with the remaining charge attributed to the competing hydrogen evolution reaction. For both OD-Cu and micron Cu electrodes, there was a near exponential increase in the CO reduction current density with respect to applied potential (FIG. 2A), indicating excellent transport of CO to the catalytic surface at the triple-phase boundary. Furthermore, a remarkable partial current density for $C_{2+}$ products (830 mA/cm$^2$) was obtained using OD-Cu at a moderate applied potential (−0.72 V vs. RHE). To compare the reaction rates of both Cu electrodes, the performance was normalized to the electrochemical surface area. The OD-Cu copper electrode exhibited higher geometric (FIG. 2A) and ECSA-corrected $C_{2+}$ current densities (not shown) than micron Cu at lower overpotentials. The enhanced activity of OD-Cu for COR in batch systems at low overpotentials has been attributed to the presence of grain boundaries, or other unique Cu facets. However, copper can undergo significant surface restructuring under a CO-rich environment, and future work involving advanced operando techniques mirroring flow cell conditions is needed to elucidate true structure-property relationships. The non-linearity at high overpotentials (not shown) is likely caused by mass transport limitations of the product gas bubbles which begin to block the catalyst at high current densities (>500 mA/cm$^2$). The two electrodes exhibited similar normalized total current densities, when normalized to the electrochemically active surface area. After a 1-hour constant current density electrolysis at 500 mA/cm$^2$, the morphology of the OD-Cu particles was maintained.

Figure 3A:
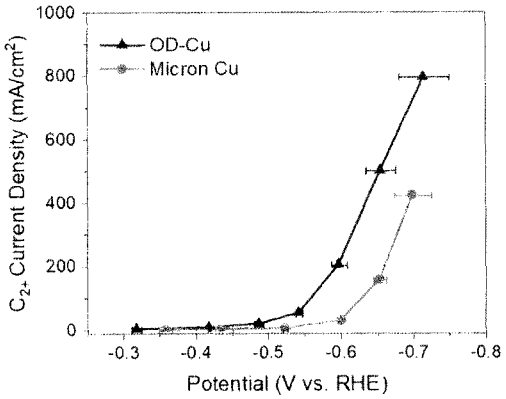
FIG. 3A shows Carbon monoxide reduction (COR) performance of oxide-derived copper (OD-Cu) and Micron Cu in terms of partial current density for $C_{2+}$ products vs. applied potential for CO reduction in 1M KOH on OD-Cu and micron Cu normalized to geometric surface area.
Figure 3B:
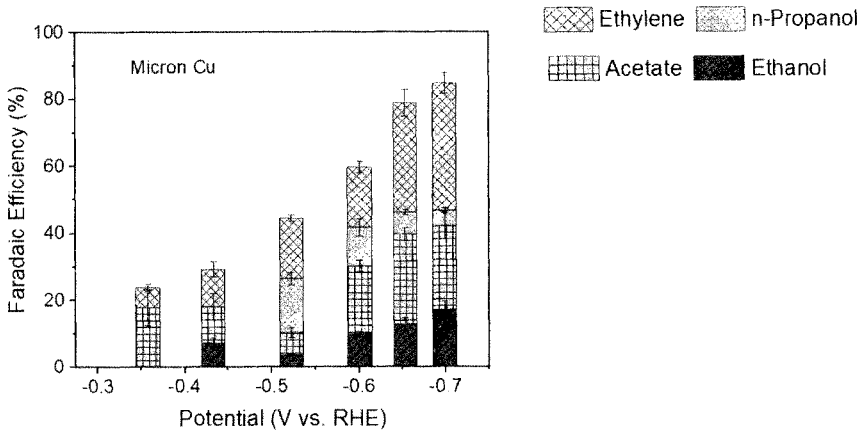
FIG. 3B shows Carbon monoxide reduction (COR) performance of oxide-derived copper (OD-Cu) and Micron Cu in terms of Faradaic efficiency (%) for $C_{2+}$ products vs. applied potential for CO reduction in 1M KOH on micron Cu. Error bars represent the standard deviation from at least three independent measurements.
Figure 3C:
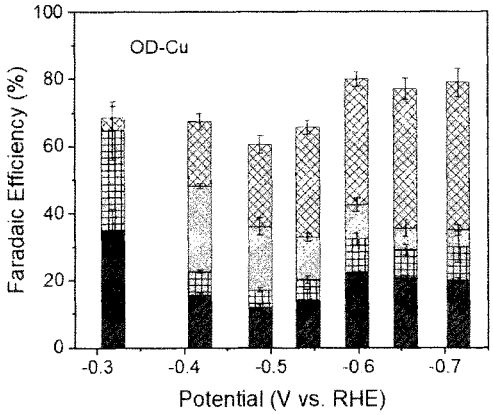
FIG. 3C shows Carbon monoxide reduction (COR) performance of oxide-derived copper (OD-Cu) and Micron Cu in terms of Faradaic efficiency (%) for $C_{2+}$ products vs. applied potential for CO reduction in 1M KOH on OD-Cu. Error bars represent the standard deviation from at least three independent measurements.

At low overpotentials, OD-Cu showed significantly higher $C_{2+}$ Faradaic efficiencies (69%, FIG. 3C) at −0.32V vs. RHE than what were observed with micron Cu (FIG. 3*d*). At −0.42V vs. RHE, the OD-Cu exhibited a 26% Faradaic efficiency towards n-propanol, which is the highest value reported for $CO_2$/CO electrolysis in the literature. As the overpotential increased, the OD-Cu began to produce significant amounts of ethylene with the total oxygenates Faradaic efficiency remaining constant at ~40%, whereas the Faradaic efficiency towards n-propanol declined to ~6%. This can be attributed to the rate of the C—C coupling reaction (which may be a thermochemical reaction step) for n-propanol formation becoming relatively slow compared to the $C_2$ intermediate protonation reaction at high overpotentials. Interestingly, the micron Cu electrode showed a similar $C_{2+}$ selectivity profile at high overpotentials, with a total $C_{2+}$ Faradaic efficiency of ~80%. This demonstrates that polycrystalline copper exhibits similar selectivity as OD-Cu for COR to $C_{2+}$ products at high overpotentials.

Comparison between COR and $CO_2$R To further illustrate the advantages of CO electrolysis over $CO_2$ electrolysis for $C_{2+}$ production, the flow electrolyzer was operated using 1 M KOH electrolyte, while switching the gas feed between CO and $CO_2$ during a constant current electrolysis at 300 mA/cm$^2$ on OD-Cu and micron Cu. Products were sampled after 20 minutes to ensure that steady-state was reached. Remarkably, the overall $C_{2+}$ Faradaic efficiency for COR (~80%) was found to be much higher than that of $CC_2R$ (~55%), as $CO_2$ reduction produced significant amounts of CO (~15%) and $HCOO^-$ (~7%) that were not counted for the total $C_{2+}$ Faradaic efficiency. Furthermore, for the same $C_{2+}$ products, COR requires ⅓ less electrons than $CO_2$R. As a result, the molar production rate of $C_{2+}$ products were more than doubled for COR.

Additionally, the overall cell voltage increased by ~100 mV when the gas feed was changed from CO to $CO_2$. The increase in cathodic overpotential could either be a result of the additional energy required to activate $CO_2$ relative to CO or a pH decrease at the electrode-electrolyte interface. The latter would likely be caused by carbonate formation through a fast chemical reaction between $CO_2$ and KOH, which served as a buffer layer and inevitably lowers the pH near the catalytic surface. Since carbonate has a lower ionic conductivity than KOH, this would lead to an increase in the cathodic overpotential.

In order to better understand the difference in interfacial pH between $CO_2$R and COR, the transport of $CO_2$/CO between the electrode-electrolyte interface and bulk electrolyte was modeled. The calculated pH gradients for $CO_2$/CO reduction under various current densities showed that in the case of $CO_2$ reduction at 0 mA/cm$^2$, there was a significant reduction in surface pH (x=0 μm) due to the fast equilibrium reaction between $CO_2$ and KOH. However, the surface pH increases with increasing current density in both $CO_2$ and CO reduction cases due to the generation of $OH^-$ ions. At 300 mA/cm$^2$, the estimated $OH^-$ concentration under CO reduction conditions is more than 1 order of magnitude higher than under $CO_2$ reduction conditions. It should also be noted that previous studies of $CO_2$ electrolysis using KOH as the electrolyte in a flow electrolyzer often assumed a pH value based on the bulk KOH concentration, leading to an underestimation of the electrode overpotential for $CO_2$ reduction in alkaline electrolyte.

Another observation from these studies is that the selectivity for ethylene, ethanol, and n-propanol did not change significantly before and after the $CO/CO_2$ switch, while the acetate Faradaic efficiency was much higher for COR and thus the major contributor to the $C_{2+}$ selectivity difference between CO and $CO_2$ reduction. Mechanistically, the formation of acetate from $CO_2$/CO reduction is under evaluation. Li and Kanan suggested that acetate formation is due to hydroxide attack of a surface intermediate due to observed increase in acetate FE at higher KOH concentrations. (Li, C. W., Ciston, J. & Kanan, M. W. Electroreduction of carbon monoxide to liquid fuel on oxide-derived nanocrystalline copper. *Nature* 508, 504-507, (2014)) Moreover, Koper et al. recently reported a favourable acetate formation at high pH in $CO_2$ reduction due to the hydroxide ions promoted Cannizzaro-type reactions at the catalytic surface. (Birdja, Y. Y. & Koper, M. T. The Importance of Cannizzaro-Type Reactions during Electrocatalytic Reduction of Carbon Dioxide. *J. Am. Chem. Soc.* 139, 2030-2034, (2017)) However, the molar ratios of the produced ethanol and acetate are not equivalent, indicating there may be an additional pathway to acetate. Garza et al. also proposed a direct reduction of CO to acetate without oxygen donation from the electrolyte through the isomerization of $*OCH_2COH$ to a three-membered ring attach to the surface. (Garza, A. J., Bell, A. T. & Head-Gordon, M.

Mechanism of $CO_2$ Reduction at Copper Surfaces: Pathways to $C_2$ Products. ACS Catal. 8, 1490-1499, (2018))

$C^{18}O$ Isotopic Labelling Studies

To further gain mechanistic insights into the formation of acetate, isotopic labelled $C^{18}O$ (Sigma Aldrich, 95 at % $^{18}O$) was fed to the electrolyzer at a constant current of 300 mA/cm$^2$ and a gas chromatography-mass spectrometry (GC-MS) system was used to analyze the liquid products. It should be noted that this investigation can only be done with labelled $C^{18}O$ rather than $C^{18}O_2$ due to the rapid equilibrium exchange of oxygen atoms when $CO_2$ reacts with KOH. Furthermore, the use of the flow cell allows for easy quantification of labelled products due to the rapid production of concentrated products that would otherwise not be possible with a batch-type reactor. The liquid products were acidified with hydrochloric acid to a pH value of ~2 after electrolysis before injecting into the GC-MS to enable acetate detection as acetic acid. If the acetate is formed through an oxygen donation from the electrolyte, it should only be partially labelled (62 amu), while a direct reduction pathway would yield fully labelled acetate (64 amu).

Figure 4A:
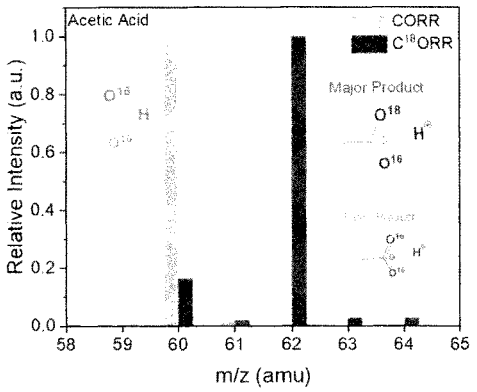
FIG. 4A shows a comparison of $CO_2R$ and COR performance in terms of mass spectrum of partially labelled acetic acid produced by $C_{18}O$ reduction at 300 mA/cm$^2$ in 1M KOH.
Figure 4B:
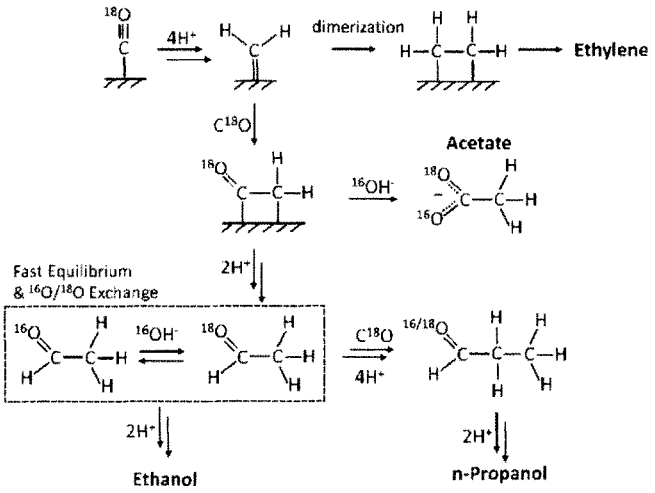
FIG. 4B shows a simplified proposed pathway for the formation of ethylene, acetate salt, ethanol, and n-propanol.

The mass fragmentation patterns of acetic acid produced from unlabelled CO and labelled $C^{18}O$ are shown in FIG. 4. The parent ion of acetic acid (60 amu) produced from unlabelled CO matches well to that of the NIST database. A clear mass shift by 2 amu (62 amu) was observed when labelled $C^{18}O$ was used, which indicates that only one oxygen of acetic acid is labelled. A small signal at 60 amu is likely due to $C^{16}O$ impurity in the feed. Since the signal at 64 amu, as well as at 63 amu, is even smaller than the observed signal at 60 amu, this signal can be attributed to the natural isotope abundance of $^{13}C$, and not acetic acid with both oxygen atoms labelled. Additionally, the signal ratio between 62 and 60 amu is close that of the ratio of $^{18}O$ and $^{16}O$ in the gas feed; and therefore, one can conclude that the observed acetic acid with a signal at 62 amu consisted of one oxygen originating from labelled $C^{18}O$ and one oxygen originating from the electrolyte, most likely from a $OH^-$ ion reacting with an intermediate species. Combining these observations with the estimated pH gradients shown in Table 2, the high acetate selectivity in COR can be attributed to a higher local pH at the electrode-electrolyte interface, where the abundance of $OH^-$ ions near the catalytic surface can easily react with an intermediate to form acetate. A proposed pathway to acetate is shown in FIG. 4B. However, it should be noted that other effects such as the presence of carbonates under $CO_2R$ conditions may also influence the selectivity.

In addition to acetic acid, ethanol and n-propanol were also detected via GC-MS along with a small amount of acetaldehyde. Surprisingly, acetaldehyde was entirely unlabelled, and ethanol/n-propanol were only partially labelled. The unlabelled acetaldehyde can be explained by the rapid oxygen exchange between acetaldehyde and water which has been extensively studied by Greenzaid et al. (Greenzaid, P., Luz, Z. & Samuel, D. A nuclear magnetic resonance study of the reversible hydration of aliphatic aldehydes and ketones. II. The acid-catalyzed oxygen exchange of acetaldehyde. *J. Am. Chem. Soc.* 89, 756-759, (1967)) This was verified by adding 0.2% of acetaldehyde, ethanol, and acetic acid to 98% $H_2{}^{18}O$. Indeed, a clear mass shift by 2 amu (46 amu) was observed with acetaldehyde; however, no oxygen exchange was observed with ethanol or acetic acid (not shown).

Therefore, the observation of only partially labelled ethanol and n-propanol is likely due to acetaldehyde oxygen exchange prior to further reduction, since acetaldehyde has been shown to be a reaction intermediate to these alcohols. Overall, this demonstrates the challenges of gaining mechanistic insights through isotopic labelled oxygen studies for CO reduction, and future work such as direct sampling at the reaction interface through differential electrochemical mass spectrometry (DEMS) is required.

Influence of KOH Concentration on COR Performance

Figure 5A:
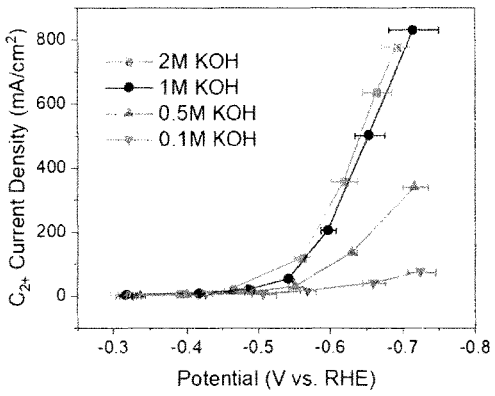
FIG. 5A shows the effect of KOH concentration on COR performance in terms of partial current density for $C_{2+}$ products for CO reduction in varying concentrations of KOH. Error bars represent the standard deviation from at least three independent measurements.

The pH effect on CO reduction was further studied by varying the KOH electrolyte concentration from 0.1M to 2.0 M. The cathode polarization curves for $C_{2+}$ products in 0.1M, 0.5 M, 1.0M, and 2.0 M KOH aqueous electrolytes are shown in FIG. 5A. Both $C_{2+}$ partial current density and Faradaic efficiency increased (FIGS. 5A and 5B) as the KOH concentration increased. While the HER partial current density also increased with increasing concentration, the HER Faradaic efficiency was dramatically reduced. Without wishing to be bound by any particular theory, it is believed that this enhancement can be attributed to two effects: 1) the reduction of charge transfer resistance across the electrolyte that improved the active area of the triple-phase boundary due to the increase in electrolyte conductivity at higher concentrations, and 2) higher pH at the electrocatalytic interface that favours C—C coupling. Although previous studies on CO reduction were primarily carried out in a 0.1 M KOH electrolyte, recent computational work have suggested that a high pH environment could enhance C—C coupling through the dimerization of adsorbed CO.

Figure 5B:
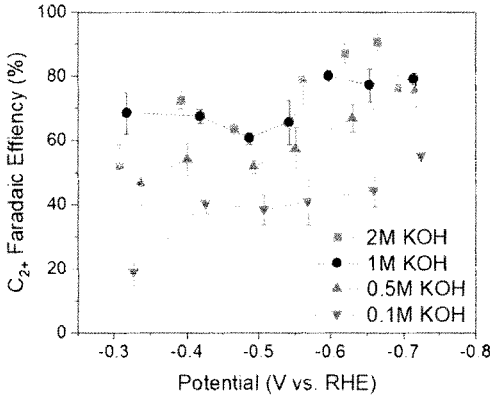
FIG. 5B shows the effect of KOH concentration on COR performance in terms of Faradaic efficiencies (%) for $C_{2+}$ products for CO reduction in varying concentrations of KOH.
Figure 6:
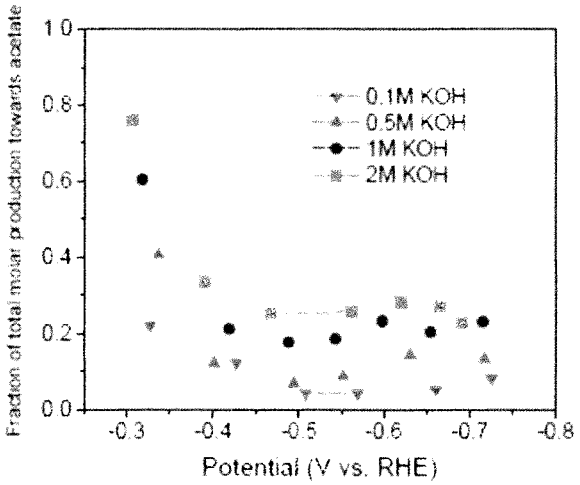
FIG. 6 shows ratio (fraction) of acetate molar production to total molar production for COR over OD-Cu at various KOH concentrations.

As reflected, FIGS. 5A and 5B clearly show that high KOH concentrations are favourable for CO reduction to $C_{2+}$ products (see Table 1 for specific product Faradaic Efficiencies). The molar production ratio of acetate to other products generally increased with increasing KOH concentration (FIG. 6), further supporting that $OH^-$ ions shift selectivity to acetate. In 1.0 M KOH electrolyte, a $C_{2+}$ partial current density of 829 mA/cm$^2$ with a total $C_{2+}$ Faradaic efficiency of 79% was achieved at a moderate potential of −0.72V vs. RHE. At a slightly lower potential (−0.67V vs. RHE) in 2.0M KOH, a $C_{2+}$ partial current density of 635 mA/cm$^2$ with a total $C_{2+}$ Faradaic efficiency of 91% was obtained. In terms of $C_{2+}$ current density and Faradaic efficiency, the results of the present disclosure are significantly better than performances reported in the current state-of-the-art $CO_2R$ (Table 2 for details).

TABLE 1

COR Flow Electrolyzer Data at various KOH electrolyte concentrations

| Potential (V vs. RHE) | Current Density (mA/cm$^2$) | Faradiac Efficiency (%) EtOH | AcO | PrOH | $C_2H_4$ | $H_2$ | Total |
|---|---|---|---|---|---|---|---|
| Sample: OD-Cu 1M KOH | | | | | | | |
| −0.32 | 3 | 35.0 | 29.6 | 0.0 | 3.8 | 6.9 | 75.4 |
| −0.42 | 10 | 15.6 | 7.0 | 25.6 | 19.2 | 18.8 | 86.2 |
| −0.49 | 30 | 11.9 | 5.2 | 18.9 | 24.5 | 24.8 | 85.3 |
| −0.54 | 80 | 13.8 | 6.3 | 12.8 | 32.7 | 21.9 | 87.5 |
| −0.60 | 255 | 22.3 | 10.1 | 10.2 | 37.5 | 16.0 | 96.0 |
| −0.65 | 650 | 20.5 | 8.5 | 6.4 | 41.5 | 16.2 | 93.3 |
| −0.72 | 1050 | 19.9 | 10.1 | 4.9 | 44.1 | 15.7 | 94.7 |
| Sample: Micron-sized Cu, 1M KOH | | | | | | | |
| −0.36 | 1 | 0.0 | 17.8 | 0.0 | 5.9 | 21.0 | 44.6 |
| −0.43 | 2.5 | 7.1 | 10.8 | 0.0 | 11.2 | 38.7 | 67.9 |
| −0.52 | 10 | 3.7 | 6.4 | 16.3 | 17.9 | 40.2 | 84.5 |
| −0.60 | 50 | 9.7 | 20.5 | 11.5 | 18.0 | 33.9 | 93.5 |
| −0.65 | 200 | 12.6 | 27.0 | 6.5 | 32.7 | 17.9 | 96.7 |
| −0.70 | 500 | 17.1 | 24.9 | 4.5 | 38.1 | 10.8 | 95.5 |
| Sample: OD-Cu, 0.1M KOH | | | | | | | |
| −0.36 | 2 | 11.8 | 4.2 | 0.0 | 2.9 | 25.3 | 44.1 |
| −0.43 | 5 | 9.9 | 5.0 | 15.6 | 9.8 | 38.8 | 79.1 |
| −0.51 | 15 | 6.9 | 1.6 | 13.2 | 16.7 | 49.5 | 87.8 |
| −0.57 | 35 | 7.2 | 1.7 | 10.8 | 21.1 | 49.7 | 90.5 |
| −0.66 | 90 | 9.0 | 2.3 | 9.8 | 23.2 | 38.0 | 82.3 |
| −0.73 | 135 | 16.8 | 4.5 | 11.1 | 22.6 | 33.6 | 88.6 |
| Sample: OD-Cu, 0.5M KOH | | | | | | | |
| −0.34 | 2 | 23.7 | 18.9 | 0.0 | 3.9 | 18.8 | 65.3 |
| −0.40 | 5 | 13.6 | 6.6 | 20.7 | 13.2 | 25.0 | 79.0 |
| −0.49 | 20 | 10.4 | 3.5 | 17.5 | 20.4 | 35.5 | 87.2 |
| −0.55 | 50 | 10.5 | 5.0 | 13.6 | 28.2 | 38.0 | 95.2 |
| −0.63 | 200 | 15.9 | 9.7 | 8.7 | 32.5 | 24.1 | 90.9 |
| −0.72 | 450 | 20.3 | 10.0 | 6.6 | 38.5 | 16.1 | 91.4 |
| Sample: OD-Cu, 2M KOH | | | | | | | |
| −0.31 | 4 | 17.3 | 31.8 | 0.0 | 2.8 | 3.4 | 55.3 |
| −0.39 | 10 | 18.4 | 13.0 | 24.4 | 16.6 | 11.6 | 84.1 |
| −0.47 | 35 | 14.5 | 8.3 | 18.8 | 21.9 | 18.1 | 81.6 |

TABLE 1-continued

COR Flow Electrolyzer Data at various KOH electrolyte concentrations

| | | | | | | | |
|---|---|---|---|---|---|---|---|
| −0.56 | 150 | 19.2 | 10.9 | 13.5 | 35.4 | 14.7 | 93.7 |
| −0.62 | 410 | 23.7 | 13.8 | 10.1 | 39.4 | 12.0 | 99.1 |
| −0.67 | 700 | 26.7 | 13.9 | 8.3 | 41.8 | 11.8 | 102.5 |
| −0.69 | 1020 | 20.4 | 9.6 | 4.5 | 41.7 | 13.8 | 89.9 |

TABLE 2

Summary of aqueous CO2R literature performance on copper electrodes

| Catalyst | Electrolyte | Potential (V vs. RHE) | $C_{2+}$ product current density (mA/cm$^2$) | $C_{2+}$ product Faradaic Efficiency (%) |
|---|---|---|---|---|
| This work | 2M KOH | −0.67 | 635 | 90.7 |
| | 1M KOH | −0.72 | 829 | 79.0 |
| Nanoporous Cu wires on GDL[7] | 1M KOH | −0.69 | 138 | 68.9 |
| CuAg alloy film (6% Ag)[8] | 1M KOH | −0.68 | 264 | 85.1 |
| 25 nm Cu film on GDL[2] | 3.5M KOH + 5M KI | −0.66 | 607 | 82 |
| Cu nps (10-50 nm) on GDL[9] | 1M KOH | −0.63 | 231 | 52.7 |
| | 1M KOH | −0.79 | 215 | 70 |
| $O_2$ plasma-treated Cu nanocubes[10] | 0.1M $KHCO_3$ | −1 | 24.8 | 73 |
| $O_2$ plasma treated Cu foil[11] | 0.1M $KHCO_3$ | −0.92 | 12 | 60 |
| Cu np on N-doped graphene[12] | 0.1M $KHCO_3$ | −1.2 | 2.4 | 63 |
| Cu nanowhiskers on GDL[13] | NA | −0.8 | 160 | 35.5 |
| Cu nanowhiskers[13] | 0.1M $KHCO_3$ | −1.2 | 31 | 52 |
| $Cu_2O$-derived Cu[14] | 0.1M $KHCO_3$ | −1.03 | 18.7 | 59.9 |
| Li-ion cycled | 0.25M $KHCO_3$ | −0.96 | 42 | 60.5 |
| Cu foil[15] | 0.25M $KHCO_3$ | −1.01 | 57 | 52 |
| Cu (100) single crystal[16] | 0.1M $KHCO_3$ | −1 | 2.9 | 57.8 |
| 3.6 um $Cu_2O$ film[17] | 0.1M $KHCO_3$ | −0.99 | 17.8 | 50.8 |
| Oxide-derived Cu foam[18] | 0.5M $NaHCO_3$ | −0.8 | 11 | 55 |

[2]Herron, J. A., Kim, J., Upadhye, A. A., Huber, G. W. & Maravelias, C. T. A general framework for the assessment of solar fuel technologies. Energy Environ. Sci. 8, 126-157, (2015).

[7]Jhong, H.-R. M., Ma, S. & Kenis, P. J. A. Electrochemical conversion of $CO_2$ to useful chemicals: current status, remaining challenges, and future opportunities. Curr. Opin. Chem. Eng. 2, 191-199, (2013).

[8]Liu, X. et al. Understanding trends in electrochemical carbon dioxide reduction rates. Nat. Commun. 8, 15438, (2017).

[9]Montoya, J. H., Shi, C., Chan, K. & Norskov, J. K. Theoretical Insights into a CO Dimerization Mechanism in $CO_2$ Electroreduction. J. Phys. Chem. Lett. 6, 2032-2037, (2015).

[10]Huang, Y., Handoko, A. D., Hirunsit, P. & Yeo, B. S. Electrochemical Reduction of $CO_2$ Using Copper Single-Crystal Surfaces: Effects of CO* Coverage on the Selective Formation of Ethylene. ACS Catal. 7, 1749-1756, (2017).

[11]Verma, S., Lu, X., Ma, S., Masel, R. I. & Kenis, P. J. A. The effect of electrolyte composition on the electroreduction of $CO_2$ to CO on Ag based gas diffusion electrodes. PCCP 18, 7075-7084, (2016).

[12]Xiao, H., Cheng, T., Goddard, W. A., 3rd & Sundararaman, R. Mechanistic Explanation of the pH Dependence and Onset Potentials for Hydrocarbon Products from Electrochemical Reduction of CO on Cu (111). J. Am. Chem. Soc. 138, 483-486, (2016).

[13]Dinh, C.-T. et al. $CO_2$ electroreduction to ethylene via hydroxide-mediated copper catalysis at an abrupt interface. Science 360, 783-787, (2018).

[14]Verma, S. et al. Insights into the Low Overpotential Electroreduction of $CO_2$ to CO on a Supported Gold Catalyst in an Alkaline Flow Electrolyzer. ACS Energy Lett. 3, 193-198, (2018).

[15]Spurgeon, J. M. & Kumar, B. A comparative technoeconomic analysis of pathways for commercial electrochemical $CO_2$ reduction to liquid products. Energy Environ. Sci. 11, 1536-1551, (2018).

[16]Reske, R., Mistry, H., Behafarid, F., Roldan Cuenya, B. & Strasser, P. Particle size effects in the catalytic electroreduction of $CO_2$ on Cu nanoparticles. J. Am. Chem. Soc. 136, 6978-6986, (2014).

[17]Loiudice, A. et al. Tailoring copper nanocrystals towards $C_2$ products in electrochemical $CO_2$ reduction. Angew. Chem. Int. Ed. 55, 5789-5792, (2016).

[18]Baturina, O. A. et al. $CO_2$ Electroreduction to Hydrocarbons on Carbon-Supported Cu Nanoparticles. ACS Catal. 4, 3682-3695, (2014).

Figure 5C:
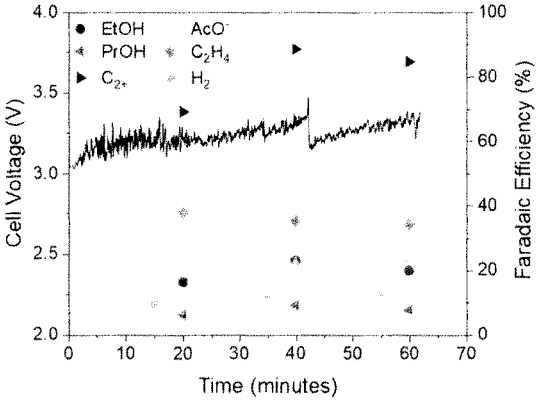
FIG. 5C shows the effect of KOH concentration on COR performance in terms of cell voltage and Faradaic efficiencies (%) for CO reduction on OD-Cu in 2M KOH at 500 mA/cm$^2$ over 1 hour. Error bars represent the standard deviation from at least three independent measurements.

The stability of the CO electrolyzer was also examined at a constant current of 500 mA/cm$^2$ with 2.0 M KOH electrolyte in a two-electrode flow cell configuration. The applied cell voltage increased from 3.05 V to 3.25 V over the course of 1-hour electrolysis with gradual increases and sudden decreases (FIG. 5C), which was caused by the gradual build-up of gas bubbles in the liquid catholyte chamber until it was flushed out at once. Despite this, a 1-hour stable performance was achieved at a cell potential of ~3.2V and a current density of 500 mA/cm$^2$. The slight decrease of total $C_{2+}$ Faradaic efficiency after 30 minutes is predominantly due to flooding issues through the GDL into the CO gas chamber, which was caused by the condensation of water vapour. At such a high current density, water quickly accumulated in the gas chamber and caused cell voltage increase and fluctuations (FIG. 5C).

In the case of $CO_2$ reduction, the same water accumulation issue also existed, but much worse stability was observed ( ). This severe degradation was likely due to carbonate formation at the electrode-electrolyte interface that blocks the pores of the GDL. Attempts to obtain higher $C_{2+}$ partial current from CO reduction at higher cell voltages were made and a total current density beyond 1 A/cm$^2$ was achieved; however, the cell performance was only maintained for less than 30 minutes because of severe flooding issues into the gas chamber. Clearly, maintaining an efficient three-phase boundary at the electrode-electrolyte interface is crucial to obtaining a high-performing CO electrolyzer that can be operated at extremely high current densities while preserving a high $C_{2+}$ selectivity.

Figure 7A:
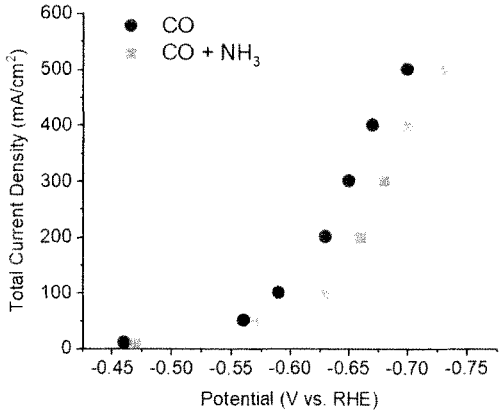
FIG. 7A shows electrode polarization curves for electrolysis in 1M KOH under pure CO gas and 2:1 ratio of $NH_3$/CO.
Figure 7B:
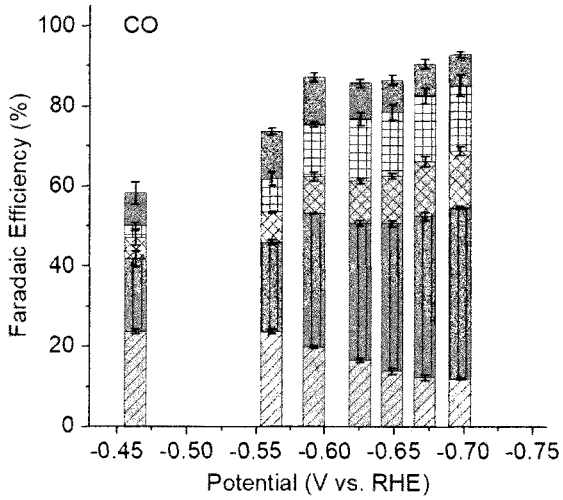
FIG. 7B shows Faradaic efficiencies (%) of various carbon-containing products vs. applied potential for electrolysis in 1M KOH under pure CO gas.
Figure 7C:
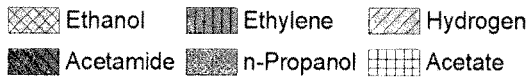
FIG. 7C shows Faradaic efficiencies (%) of various carbon-containing products vs. applied potential for electrolysis in 1M KOH under 2:1 ratio of $NH_3$/CO.
Figure 7C:
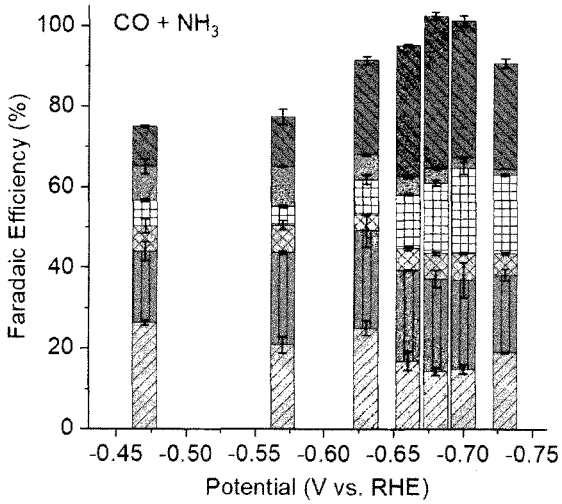

Electroreduction of CO or $CO_2$ in the Presence of a Co-Reactant, Such as Ammonia Cu cathodes were prepared by coating Cu nanoparticles (NPs) onto a gas diffusion layer (GDL). The size distribution and monoclinic phase of the Cu NPs were characterized using scanning electron microscopy (SEM), X-ray diffraction (XRD), and X-ray photoelectron spectroscopy (XPS). The Cu NPs are mainly highly crystalline metallic Cu with an average particle size of 50±20 nm, but they also contain a small fraction of copper oxides. CO electroreduction activity was measured through steady-state galvanostatic electrolysis in a 1M KOH electrolyte. Under a pure CO gas feed, a near-exponential polarization response was observed (FIG. 7A, Table 3), with up to ~80% $C_{2+}$ products for a total current density of 500 mA/cm$^2$. The major CO electroreduction products observed were ethylene, ethanol, acetate, and n-propanol (FIG. 7C).

TABLE 3

COR (I), COR with $NH_3$ (II) flow electrolyzer data, and the corresponding stability test data (III) using Cu nanoparticles as the CO reduction catalyst.

I
Electrolyte: 1M KOH; Flow gas: CO (15 mL/min)

| Potential | Current density | Faradaic efficiency (%) | | | | |
|---|---|---|---|---|---|---|
| (V vs. RHE) | (mA cm$^{-2}$) | $H_2$ | $C_2H_4$ | EtOH | $AcO^-$ | PrOH |
| −0.46 | 10 | 23.6 | 18.1 | 5.3 | 3.1 | 8.1 |
| −0.56 | 50 | 23.5 | 22.3 | 7.5 | 8.3 | 11.9 |
| −0.59 | 100 | 19.7 | 33.3 | 9.3 | 13.0 | 11.8 |
| −0.63 | 200 | 16.4 | 34.2 | 10.5 | 15.5 | 9.0 |
| −0.65 | 300 | 13.8 | 36.8 | 11.8 | 15.9 | 8.0 |
| −0.67 | 400 | 12.2 | 40.2 | 13.6 | 16.5 | 7.9 |
| −0.7 | 500 | 11.8 | 42.7 | 14.2 | 16.3 | 7.8 |

II
Electrolyte: 1M KOH; Flow gas: CO (7.5 mL/min), $NH_3$ (15 mL/min)

| Potential | Current density | Faradaic efficiency (%) | | | | | |
|---|---|---|---|---|---|---|---|
| (V vs. RHE) | (mA cm$^{-2}$) | $H_2$ | $C_2H_4$ | EtOH | $AcO^-$ | PrOH | $CH_3CONH_2$ |
| −0.47 | 10 | 26.3 | 17.8 | 6.2 | 6.3 | 8.5 | 10.0 |
| −0.57 | 50 | 20.9 | 22.8 | 6.8 | 4.7 | 9.9 | 12.3 |
| −0.63 | 100 | 25.0 | 24.2 | 4.0 | 8.7 | 6.2 | 23.5 |
| −0.66 | 200 | 16.9 | 22.5 | 5.4 | 13.3 | 4.5 | 32.7 |
| −0.68 | 300 | 14.3 | 22.9 | 6.4 | 17.5 | 3.6 | 37.9 |
| −0.7 | 400 | 14.9 | 22.1 | 6.7 | 21.1 | 2.5 | 34.2 |
| −0.73 | 500 | 19.1 | 19.1 | 5.5 | 19.5 | 1.4 | 26.3 |

III
Electrolyte: 1M KOH; Flow gas: CO (7.5 mL/min), $NH_3$ (15 mL/min); 100 mA/cm$^2$

| Potential | Time | Faradaic efficiency (%) | | | | | |
|---|---|---|---|---|---|---|---|
| (V vs. RHE) | (h) | $H_2$ | $C_2H_4$ | EtOH | $AcO^-$ | PrOH | $CH_3CONH_2$ |
| −0.64 | 1 | 25.3 | 28 | 4.4 | 13.5 | 5.8 | 21.7 |
| −0.64 | 2 | 25.9 | 26.1 | 3.9 | 14.8 | 5.9 | 21.8 |
| −0.65 | 3 | 26.2 | 25.6 | 3.8 | 11.6 | 4.6 | 20.3 |
| −0.65 | 4 | 26.5 | 25.1 | 3.3 | 12.1 | 5.0 | 25.4 |
| −0.66 | 5 | 26.9 | 24.8 | 4.2 | 14.9 | 5.7 | 25.5 |
| −0.66 | 6 | 27.2 | 24.3 | 3.4 | 11.1 | 3.1 | 24.1 |
| −0.68 | 7 | 27.5 | 23.9 | 4.2 | 11.5 | 4.3 | 26.5 |
| −0.70 | 8 | 21.8 | 24.1 | 4.3 | 16.4 | 3.0 | 25.8 |

Figure 8A:
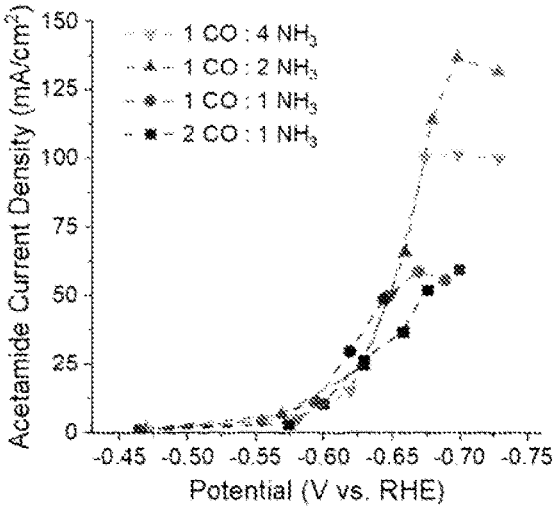
FIGS. 8A and 8B show electrolysis performance in terms of current density and Faradaic efficiencies respectively vs. applied potential for acetamide production for different CO/$NH_3$ feed ratios in 1M KOH.
Figure 8B:
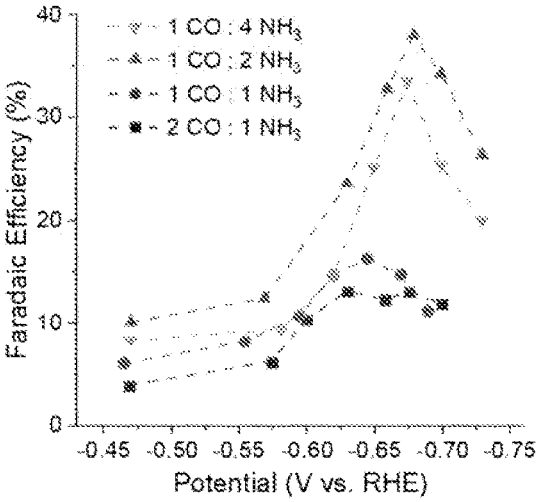
Figure 8C:
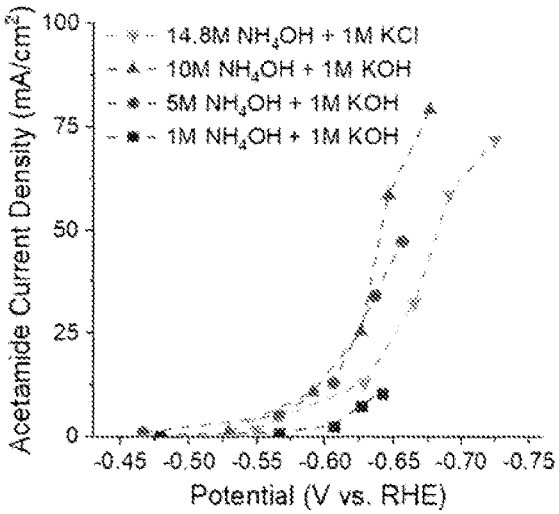
FIGS. 8C and 8D show CO reduction in ammonium hydroxide electrolytes in terms of current density and Faradaic efficiencies respectively vs. applied potential for acetamide production at various amounts of $NH_4OH$ with 1M KOH and with 0.5M KCl.
Figure 8D:
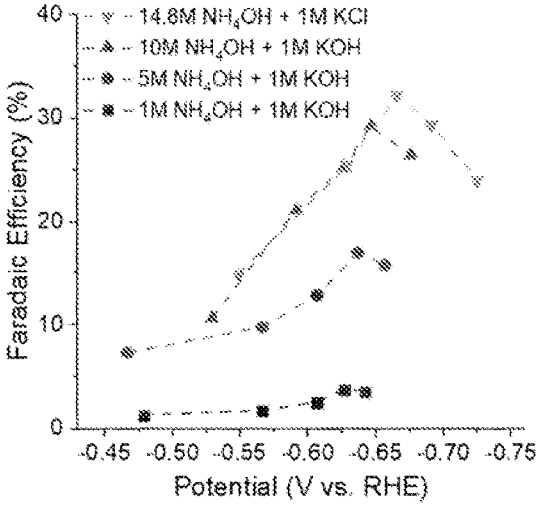
Figure 9:
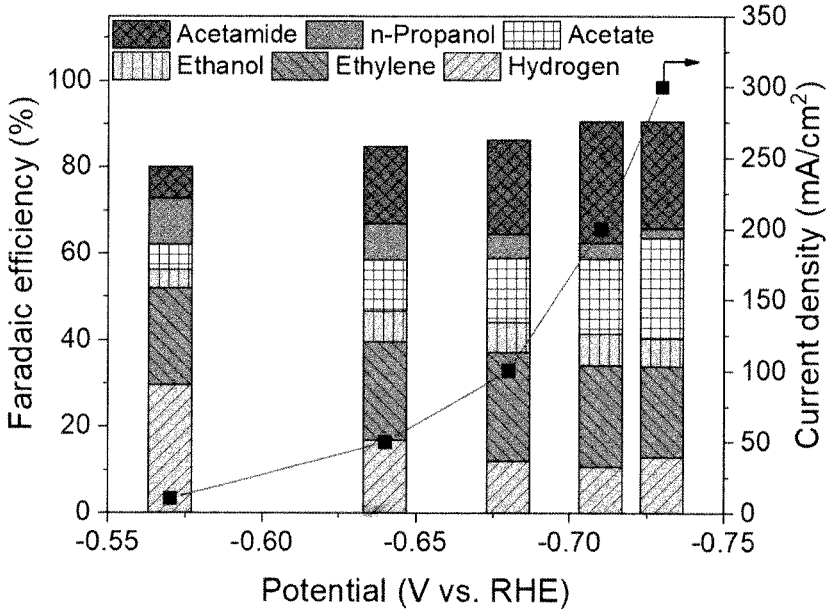
FIG. 9 shows performance for CO electroreduction with 2:1 (mol/mol) $NH_3$/CO feed in 1M KOH on micron Cu in terms of current density and Faradaic efficiencies vs. applied potential.

After establishing the baseline of CO electrolysis activity, ammonia gas was fed together with CO in a $NH_3$:CO=2:1 (mol/mol) ratio. In the presence of ammonia gas, the required potential to achieve the same current density increased by ~30 mV (FIG. 7A, Table 3), likely due to the reduced CO partial pressure in the flow cell. Remarkably, the presence of ammonia led to the significant production of acetamide, with a Faradaic efficiency up to 38% and a partial current density of 114 mA/cm$^2$ at −0.68 V vs. reversible hydrogen electrode (RHE). In addition, the observed amounts of ethylene, acetate, and alcohols were greatly reduced at moderate to high potentials (FIG. 7C). Increasing the fraction of CO in the gas feed shifted selectivity towards pure CO reduction products, while increasing the ratio of ammonia beyond 2:1 did not significantly influence the acetamide selectivity (FIGS. 8A and 8B). Similar results were obtained using a mixture of ammonium hydroxide and KOH as the catholyte together with a pure CO gas feed (FIGS. 8C and 8D). This suggests that acetamide can form in both gas and liquid phase ammonia with appreciable Faradaic efficiency. To evaluate the stability of Cu-catalyzed CO electrolysis process in the presence of ammonia, an 8-hour continuous experiment was performed at a total current density of 100 mA/cm$^2$ leading to stable production of acetamide as shown in Table 3. The spent Cu catalyst was characterized by SEM, XRD, and XPS and no visible change was observed in morphology and structure after electrolysis. Furthermore, significant amounts of acetamide were also produced on other Cu-based catalysts (FIG. 9), suggesting that the formation of acetamide is universal in Cu-catalyzed CO electrolysis in the presence of ammonia.

Figure 10:
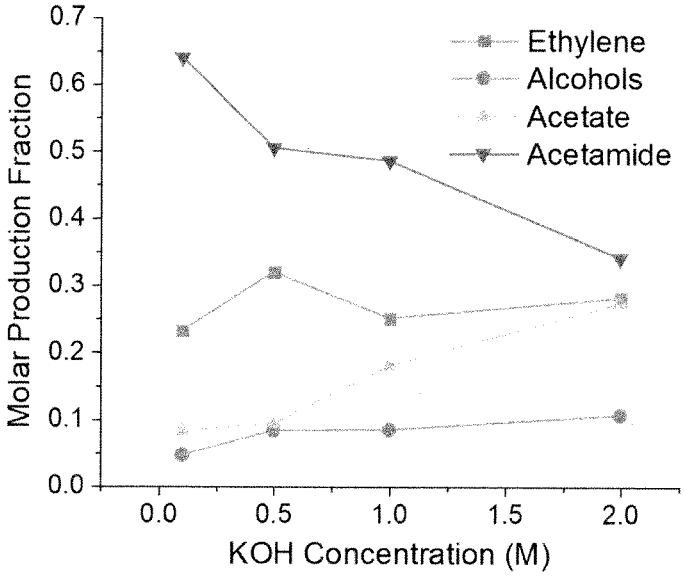
FIG. 10 shows CO electroreduction with 2:1 (mol/mol) ammonia to CO ratio in different KOH concentrations in terms of molar production fraction.

These experimental results strongly suggest that a surface ketene intermediate is likely formed on the Cu catalyst surface during CO electroreduction and nucleophilically attacked by either hydroxide or ammonia to form acetate or acetamide, respectively, under highly alkaline environments. This is further supported by a shift in selectivity from amide to acetate for CO electrolysis with ammonia in electrolytes with increasing KOH concentration (FIG. 10). Additionally, because the ketene intermediate contains one oxygen originated from CO, the resulting acetate should contain two oxygen atoms with one from CO and the other from water, which is in good agreement with our recent studies. In the case of nucleophilic attack by ammonia, the oxygen in acetamide should originate from CO. The origin of oxygen in acetamide was verified by conducting a $C^{18}O$ isotopic labeling study, where $^{18}O$ labeled acetamide was the dominant product, consistent with the proposed ketene mediated reaction mechanism.

To further elucidate the reaction mechanism, Quantum Mechanics (QM, PBE-D3 DFT) was used to investigate the electrocatalytic formation of acetamide in the presence of ammonia, using the same full solvent methods previously applied to $CO_2$ reduction and CO reduction on Cu(100). Our earlier QM full solvent calculations showed that under neutral or basic conditions the reaction mechanism involves CO dimerization and sequential transfer of H from two surface water to form (HO)C*—C*OH with an overall free energy barrier at 298K of $\Delta G^{\ddagger}$=0.69 eV. This then leads to O═C*—$CH_2$ with $\Delta G^{\ddagger}$=0.62 eV that subsequently goes through two separate pathways to form $C_2H_4$ (90%) and ethanol (10%). Now consider a new step starting with (HO)C*—C*OH. It was found that $\Delta G^{\ddagger}$=0.59 eV forms C*═C═O through a water mediated pathway. Next it was found that C—N bond formation arises from $NH_3$ reacting with *C═C═O to form *C═C(OH)$NH_2$ with $\Delta G^{\ddagger}$=0.51 eV via a water mediated reaction pathway. Then, it was found that *C═C(OH)$NH_2$ isomerizes into *CH—C(═O)$NH_2$ via keto-enol tautomerism which is exergonic by −0.37 eV. These latter two reactions are not electrochemical, so that *CH—C(═O)$NH_2$ remains a 2e intermediate just as for *C═C═O. The subsequent steps consist of two proton-coupled electron transfer (PCET) to acetamide product. With these new insights, one can extend the reaction networks of CO reduction to ethylene and ethanol by including the branches of acetamide from $NH_3$ addition.

The possibility of the *C═C═O intermediate was first proposed by Calle-Vallejo and Koper, which was postulated as an intermediate in the ethylene pathway. (Calle-Vallejo, F. & Koper, M. T. M. Theoretical Considerations on the Electroreduction of CO to $C_2$ Species on Cu(100) Electrodes. *Angew. Chem. Int. Ed.* 52, 7282-7285, (2013)) Later full solvent QM showed that the formation of $C_2H_4$ derives from C*═C*OH as in FIG. 2. The new QM calculations of the present disclosure found that *C═C═O derives from dehydration of *COH—COH. Thus, in the competition with *C═COH (from PCET), *C═C═O prefers high pH and less negative potential. This is consistent with the experimental observation of exclusive acetate formation on Cu nanoparticle at pH 14 and −0.25 V vs. RHE. (Feng, X. F., Jiang, K. L., Fan, S. S. & Kanan, M. W. A Direct Grain-Boundary-Activity Correlation for CO Electroreduction on Cu Nanoparticles. ACS Cent. Sci. 2, 169-174, (2016))

Figures 11A, 11B, 11C, 11D:
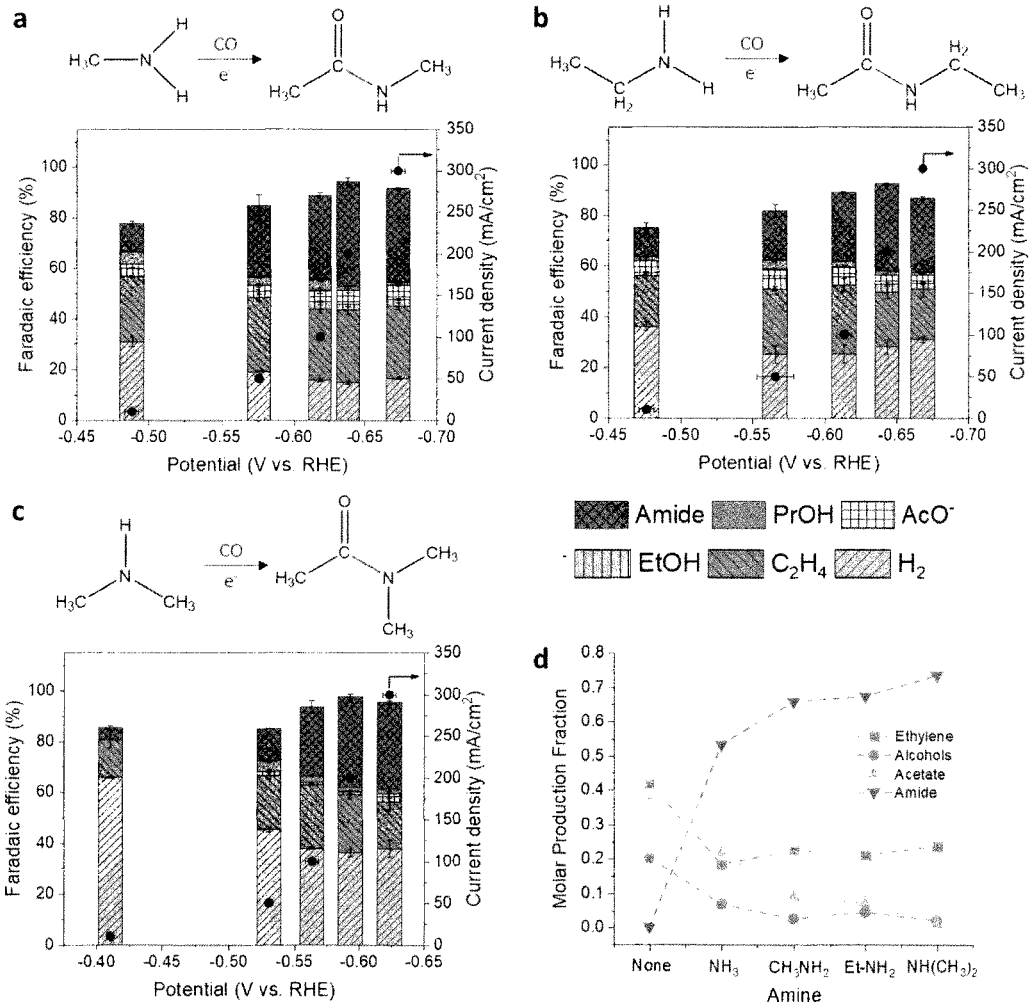
FIG. 11A shows total current density and Faradaic efficiencies for CO electrolysis in 1M KCl solution containing 5M methylamine.
FIG. 11B shows total current density and Faradaic efficiencies for CO electrolysis in 1M KCl solution containing 5M ethylamine (3B).
FIG. 11C shows total current density and Faradaic efficiencies for CO electrolysis in 1M KCl solution containing 5M dimethylamine (3C).
FIG. 11D shows molar production fraction for different carbon-containing products excluding hydrogen at 200 mA/cm$^2$ for CO reduction with various amines.

As the key intermediate towards acetate and acetamide in Cu-catalyzed CO electroreduction, ketene is also known to be highly reactive with other amine-type nucleophilic agents. Therefore, Cu-catalyzed CO electrolysis was investigated in the presence of additional amines with the hope to produce the corresponding amides. The electroreduction of a pure CO gas feed was performed using 5M solutions of methylamine, ethylamine, and dimethylamine containing 1M KCl as supporting electrolyte. 1M KCl was used to enhance the ionic conductivity of the electrolytes. As shown in FIGS. 11A-11C, analogous results were obtained to the CO/$NH_3$ system where significant amounts of N-methylacetamide, N-ethylacetamide, and N,N-dimethylacetamide were produced at high total current densities up to 200 mA/cm$^2$ with peak Faradaic efficiencies of 42%, 34%, and 36%, respectively (Table 4). The formation of these amides was confirmed using mass and $^1$HNMR spectrometry.

TABLE 4

Flow electrolyzer data for COR with different amino-containing reactants using Cu NPs as the CO reduction catalyst.

| | Electrolyte: 5M $NH_3$ $H_2O$ in 1M KOH; Flow gas: CO (15 mL/min) | | | | | | |
|---|---|---|---|---|---|---|---|
| Potential | Current density | Faradaic efficiency (%) | | | | | |
| (V vs. RHE) | (mA cm$^{-2}$) | $H_2$ | $C_2H_4$ | EtOH | $AcO^-$ | PrOH | $CH_3CONH_2$ |
| −0.47 | 10 | 23.9 | 20.5 | 10.7 | 9.4 | 15.0 | 7.2 |
| −0.57 | 50 | 22.6 | 21.9 | 8.2 | 8.1 | 12.4 | 9.6 |
| −0.61 | 100 | 19.6 | 28.8 | 9.1 | 11.9 | 10.7 | 12.7 |

TABLE 4-continued

Flow electrolyzer data for COR with different amino-containing reactants using Cu NPs as the CO reduction catalyst.

| | | | | | | | |
|---|---|---|---|---|---|---|---|
| −0.64 | 200 | 13.3 | 29.3 | 11.8 | 16.1 | 11.9 | 16.9 |
| −0.66 | 300 | 10.8 | 30.6 | 11.9 | 15.2 | 9.3 | 15.7 |

Electrolyte: 5M $CH_3NH_2$ in 1M KCl; Flow gas: CO (15 mL/min)

| Potential | Current density | Faradaic efficiency (%) | | | | | |
|---|---|---|---|---|---|---|---|
| (V vs. RHE) | (mA $cm^{-2}$) | $H_2$ | $C_2H_4$ | EtOH | $AcO^-$ | PrOH | $CH_3CONHCH_3$ |
| −0.49 | 10 | 30.7 | 26.2 | 3.3 | 1.6 | 4.9 | 11.0 |
| −0.58 | 50 | 18.9 | 29.3 | 2.7 | 2.2 | 3.3 | 28.3 |
| −0.62 | 100 | 15.9 | 27.9 | 2.9 | 4.3 | 4.4 | 33.2 |
| −0.64 | 200 | 14.8 | 28.5 | 2.3 | 5.7 | 1.5 | 41.5 |
| −0.67 | 300 | 16.6 | 28.5 | 2.5 | 5.6 | 1.2 | 37.1 |

Electrolyte: 5M $CH_3CH_2NH_2$ in 1M KCl; Flow gas: CO (15 mL/min)

| Potential | Current density | Faradaic efficiency (%) | | | | | |
|---|---|---|---|---|---|---|---|
| (V vs. RHE) | (mA $cm^{-2}$) | $H_2$ | $C_2H_4$ | EtOH | $AcO^-$ | PrOH | $CH_3CONHCH_2CH_3$ |
| −0.48 | 10 | 36.1 | 20.2 | 1.2 | 4.7 | 1.4 | 11.6 |
| −0.57 | 50 | 25.1 | 26.0 | 4.0 | 3.6 | 3.6 | 19.7 |
| −0.61 | 100 | 25.3 | 27.4 | 3.2 | 3.7 | 2.4 | 27.1 |
| −0.64 | 200 | 28.0 | 21.5 | 3.4 | 3.6 | 1.6 | 34.4 |
| −0.67 | 300 | 31.0 | 19.8 | 2.4 | 3.4 | 0.9 | 29.4 |

Electrolyte: 5M $CH_3NHCH_3$ in 1M KCl; Flow gas: CO (15 mL/min)

| Potential | Current density | Faradaic efficiency (%) | | | | | |
|---|---|---|---|---|---|---|---|
| (V vs. RHE) | (mA $cm^{-2}$) | $H_2$ | $C_2H_4$ | EtOH | $AcO^-$ | PrOH | $CH_3CON(CH_3)_2$ |
| −0.41 | 10 | 65.8 | 14.8 | 0 | 0 | 0 | 4.6 |
| −0.53 | 50 | 45.4 | 21.1 | 1.8 | 0 | 4.1 | 12.7 |
| −0.56 | 100 | 38.0 | 25.0 | 0.8 | 0 | 2.6 | 27.4 |
| −0.59 | 200 | 36.2 | 22.9 | 0.8 | 0.5 | 1.6 | 35.7 |
| −0.62 | 300 | 37.8 | 18.5 | 2.2 | 1.1 | 1.8 | 34.3 |

The molar fraction of each product (excluding hydrogen) in each amine system is shown in FIG. 11D. Data for pure CO electrolysis were also shown for comparison. In the presence of amines, the molar fractions for ethylene and ethanol are reduced by about two-fold and four-fold, respectively, which is likely due to a rapid reaction between amine and ketene intermediate before the intermediate can be further reduced. Remarkably, the trend of amide molar fraction across various amines is opposite that of acetate, and correlates well with the reactivity, or nucleophilicity, of the precursor amino group. The reactive N—H bond is weakest for dimethylamine and strongest for ammonia, with methylamine and ethylamine in between. Since the amine competes with hydroxide for reaction with the ketene intermediate, it is reasonable that dimethylamine produces the highest ratio of amide to acetate, while ammonia produces the lowest. Therefore, these observations further support the mechanism proposed earlier, and provide important mechanistic insight into the Cu-catalyzed CO electroreduction reaction.

Figure 12A:
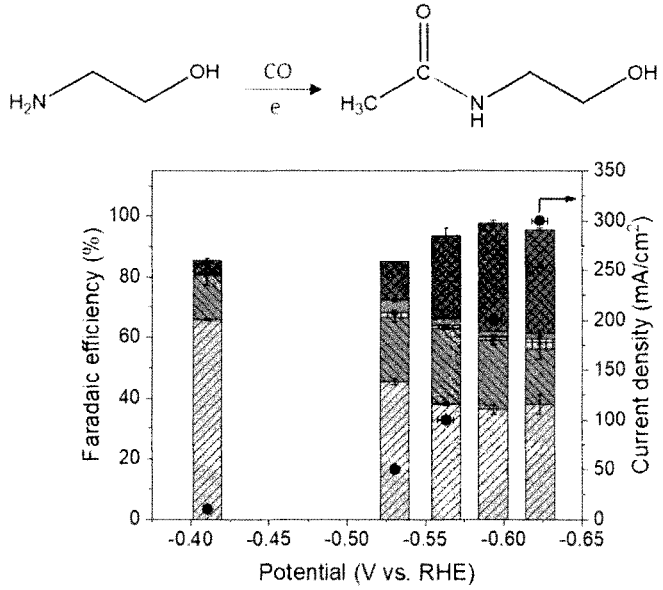
FIG. 12A shows CO electrolysis data using 5M solution of ethanol amine with 1M KOH, with the potentials estimated based on the pH values of bulk electrolytes.
Figure 12B:
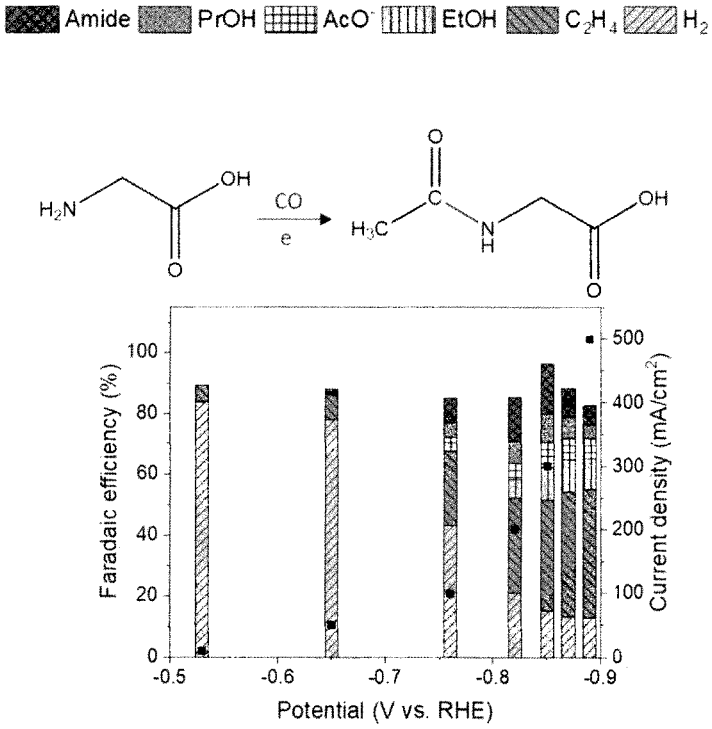
FIG. 12B shows CO electrolysis data using 3M solution of glycine with 1M KOH, with the potentials estimated based on the pH values of bulk electrolytes.
Figure 13:
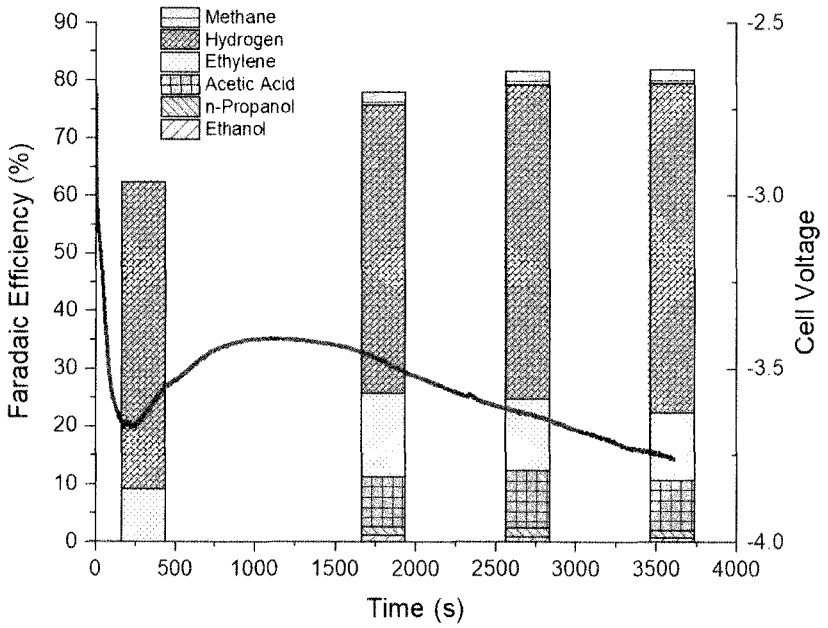
FIG. 13 shows Faradaic efficiencies and cell voltage as a function of time, for two-compartment CO flow electrolyzer shown in FIG. 1D, using water as a nucleophilic co-reactant resulting in the production of acetic acid. The anolyte pH was in the range of 2 to 4.

Additionally, the present disclosure further extends the range of products to acetamides containing hydroxyl and carboxylate functional groups. Acetic monoethanolamide and aceturic acid were produced by performing CO electrolysis in solutions of ethanolamine and glycine, respectively (FIGS. 12A and 12B). As these products contain reactive functional groups, they can be used as potential precursors to build larger molecules with higher values. This opens up a wide library of chemical transformations in which CO electrolysis can play an important role. While the goal of this work is to demonstrate the concept of electrochemical C—N bond formation, future studies can identify and optimize the production of additional species.

In summary, the present disclosure provides a new route to produce a variety of carbon-containing products generated through CO electrolysis in the presence of nucleophilic co-reactants, including but not limited to, forming amides through co-reaction with amines, and acetate or acetic acid through co-reaction with hydroxide or water. Particularly, N,N-dimethylacetamide has significant usage as a polymerization solvent, and currently requires harsh synthesis conditions. More importantly, the concept of nucleophilic attack of ketene intermediate in Cu-catalyzed CO electroreduction enables the formation of a much wider range of chemicals containing not only C—C bonds but also carbon-heteroatom bonds, which cannot be built in conventional CO electrolysis processes. The ability to produce heteroatom containing carbon species would greatly increase the potential of $CO_2$/CO electrolysis technologies for commercial applications.

While preferred embodiments of the invention have been shown and described herein, it will be understood that such embodiments are provided by way of example only. Numerous variations, changes and substitutions will occur to those skilled in the art without departing from the spirit of the invention. Accordingly, it is intended that the appended claims cover all such variations as fall within the spirit and scope of the invention.

What is claimed is:

1. A method of electroreduction in a flow electrolyzer with a working electrode and a counter electrode comprising steps of:

streaming a stream consisting essentially of carbon monoxide into the flow electrolyzer, and electrocatalyzing carbon monoxide from the stream consisting essentially of carbon monoxide in the presence of one or more nucleophilic co-reactants in contact with a catalytically active material present on the working electrode thereby forming one or more carbon-containing products electrocatalytically, wherein the working electrode is a cathode and the catalytically active material is a cathodic catalytically active material comprised of at least one of copper, copper oxide, or a copper-containing material, wherein the one or more carbon-containing products comprises acetic acid, acetate, acetaldehyde, amides, thioesters, or a combination thereof, and wherein the one or more nucleophilic co-reactants are selected from the group consisting of ammonia, amines, alcohols, carboxylic acids and thiols comprising one or more nucleophilic functional groups per molecule bearing at least one active hydrogen selected from hydroxyl, thiol, carboxyl, primary amino and secondary amino.

2. The method according to claim 1, wherein the counter electrode is an anode comprising an anodic catalytically active material comprised of at least one metal selected from the group consisting of iridium, nickel, iron, and tin.

3. The method according to claim 2, wherein the at least one metal is present, at least in part, as a metal oxide.

4. The method according to claim 2, wherein the method further comprises using an anolyte and an optional catholyte, wherein the anolyte comprises at least one metal cation and wherein the optional catholyte comprises at least one of carbonate, bicarbonate, chloride, or iodide.

5. The method according to claim 4, wherein the step of electrocatalyzing comprises the steps of:

a) streaming the anolyte through an anolyte chamber, the stream consisting essentially of carbon monoxide through a fluid chamber and optionally the catholyte through an optional catholyte chamber of the flow electrolyzer;

b) streaming the one or more nucleophilic co-reactants with the anolyte, the stream consisting essentially of carbon monoxide, and, if present, the optional catholyte;

c) electrically connecting the anode and the cathode using a source of electrical current, wherein the catalytically active material is present on the cathode, thereby forming the one or more carbon-containing products electrocatalytically.

6. The method according to claim 5, wherein the working electrode further comprises the cathodic catalytically active material present on a carbon or a conductive support, and wherein the cathodic catalytically active material present on the carbon or the conductive support is dispersed in an ion conducting polymer or a hydrophobic polymer and deposited on a porous membrane material.

7. The method according to claim 6, and wherein the porous membrane material comprises an anion exchange membrane.

8. The method according to claim 1, wherein the cathodic catalytically active material is present on a carbon or a conductive support, and the cathodic catalytically active material is dispersed in an ion conducting polymer or a hydrophobic polymer and deposited on a porous gas diffusion layer or porous membrane material.

9. The method according to claim 1, wherein the one or more carbon-containing products further comprises of methane, ethylene, ethanol, propanol, or a combination thereof.

10. The method according to claim 1, wherein the step of electrocatalyzing is performed at a current density in the range of 0.1-3000 $mA/cm^2$.

11. The method according to claim 1, wherein the step of electrocatalyzing is performed at a current density in the range of 1000-3000 $mA/cm^2$.

12. The method according to claim 1, wherein the method further comprises using an anolyte and an optional catholyte, wherein the anolyte comprises at least one metal cation and wherein the optional catholyte if present comprises at least one of carbonate, bicarbonate, chloride, or iodide.

13. The method according to claim 12, wherein the step of electrocatalyzing comprises steps of:

a) streaming the anolyte through an anolyte chamber, the stream consisting essentially of carbon monoxide through a fluid chamber and optionally the catholyte through an optional catholyte chamber of the flow electrolyzer;

b) streaming the one or more nucleophilic co-reactants with the anolyte, the stream consisting essentially of carbon monoxide, and, if present, the optional catholyte;

c) electrically connecting the anode and the cathode using a source of electrical current, wherein the catalytically active material is present on the cathode, thereby forming the one or more B carbon-containing products electrocatalytically.

14. The method according to claim 1, wherein the one or more nucleophilic co-reactants is selected from the group consisting of ammonia and an amine.

15. The method according to claim 1, wherein the one or more nucleophilic co-reactants is an amine.

16. The method according to claim 1, wherein the one or more nucleophilic co-reactants are selected from the group consisting of $C_1$-$C_6$ aliphatic primary amines, $C_1$-$C_6$ aliphatic secondary amines, aromatic primary amines, and aromatic secondary amines.

17. The method according to claim 1, wherein the one or more nucleophilic co-reactants is an alcohol.

* * * * *